US011613830B2

(12) United States Patent
Alex et al.

(10) Patent No.: US 11,613,830 B2
(45) Date of Patent: Mar. 28, 2023

(54) MULTI-LAYERED WOVEN ELEMENT

(71) Applicant: NIKE, INC., Beaverton, OR (US)

(72) Inventors: Meggin B. Alex, Beaverton, OR (US); Martin Wragg, Beaverton, OR (US)

(73) Assignee: NIKE, INC., Beaverton, OR (US)

( * ) Notice: Subject to any disclaimer, the term of this patent is extended or adjusted under 35 U.S.C. 154(b) by 379 days.

(21) Appl. No.: 15/403,945

(22) Filed: Jan. 11, 2017

(65) Prior Publication Data

US 2017/0198424 A1 Jul. 13, 2017

Related U.S. Application Data

(60) Provisional application No. 62/277,777, filed on Jan. 12, 2016.

(51) Int. Cl.
*D03D 25/00* (2006.01)
*D03D 13/00* (2006.01)
(Continued)

(52) U.S. Cl.
CPC ..... *D03D 11/00* (2013.01); *D03D 11/02* (2013.01); *D03D 13/00* (2013.01); *D03D 15/00* (2013.01); *D03D 15/283* (2021.01); *D03D 15/43* (2021.01); *D03D 19/00* (2013.01); *D03D 25/00* (2013.01); *D03D 31/00* (2013.01); *D03D 47/34* (2013.01); *D03D 47/38* (2013.01); *D03D 49/62* (2013.01);
(Continued)

(58) Field of Classification Search
None
See application file for complete search history.

(56) References Cited

U.S. PATENT DOCUMENTS 173,677 A * 2/1876 Scheppers
1,792,453 A * 2/1931 Thomas ..... D03D 11/00 139/413
(Continued)

FOREIGN PATENT DOCUMENTS

CN 203080178 * 7/2013
CN 203373506 * 1/2014
(Continued)

OTHER PUBLICATIONS

Machine translation of CN203373506, Lu (Year: 2014).*
(Continued)

*Primary Examiner* — Shawn Mckinnon
(74) *Attorney, Agent, or Firm* — Shook, Hardy & Bacon LLP

(57) ABSTRACT

The present embodiments provide a woven element having a first plurality of warp threads extending in a first direction and integrated into a first surface on a front side of the woven element. The woven element may have a second plurality of warp threads extending in the first direction, where the second plurality of warp threads is integrated into a second surface on a back side of the woven element. A first weft thread may extend in a second direction, where a first portion of the first weft thread is positioned in front of at least one warp thread of the first plurality of warp threads to form at least a portion of a graphic image on the front surface. A second portion of the first weft thread may extend between the first plurality of warp threads and the second plurality of warp threads.

18 Claims, 23 Drawing Sheets

(51) Int. Cl.

| | |
|---|---|
| ***D03D 11/00*** | (2006.01) |
| ***D03D 15/00*** | (2021.01) |
| ***D03D 11/02*** | (2006.01) |
| ***D03J 1/08*** | (2006.01) |
| ***D03D 47/34*** | (2006.01) |
| ***D03D 47/38*** | (2006.01) |
| ***D03J 1/04*** | (2006.01) |
| ***D03J 1/16*** | (2006.01) |
| ***D03D 19/00*** | (2006.01) |
| ***D03D 49/62*** | (2006.01) |
| ***D03D 31/00*** | (2006.01) |
| ***D03D 49/68*** | (2006.01) |
| ***D03D 15/43*** | (2021.01) |
| ***D03D 15/283*** | (2021.01) |

(52) U.S. Cl.
CPC ..... *D03D 49/68* (2013.01); *D03J 1/04* (2013.01); *D03J 1/08* (2013.01); *D03J 1/16* (2013.01)

(56) References Cited

U.S. PATENT DOCUMENTS

| | | | | |
|---|---|---|---|---|
| 8,800,606 | B2 | 8/2014 | Cross et al. | |
| 8,839,824 | B2 | 9/2014 | Cross et al. | |
| 9,416,467 | B2 | 8/2016 | Cross et al. | |
| 9,533,855 | B2 | 1/2017 | Dua et al. | |
| 2004/0062917 | A1 | 4/2004 | South | |
| 2013/0186506 | A1* | 7/2013 | Cross | D06B 1/00 139/68 |
| 2013/0189890 | A1 | 7/2013 | Cross et al. | |
| 2013/0255103 | A1* | 10/2013 | Dua | A43B 1/04 36/87 |
| 2017/0101732 | A1 | 4/2017 | Dua et al. | |

FOREIGN PATENT DOCUMENTS

| | | |
|---|---|---|
| FR | 1414230 | 10/1965 |
| JP | S57154430 A | 9/1982 |
| JP | 57-185790 U | 11/1982 |
| JP | 4-127288 U | 11/1992 |

OTHER PUBLICATIONS

Machine translation of CN203080178, Wang et al. (Year: 2013).*
PCT International Search Report and Written Opinion dated Jun. 1, 2017 in PCT Patent Application No. PCT/US2017/013009, 15 pages.
International Preliminary Report on Patentability dated Mar. 13, 2018 in PCT Patent Application No. PCT/US2017/013009, 7 pages.
Office Action received for Canadian Patent Application No. 3010957, dated May 28, 2020, 4 pages.
Office Action received for European Patent Application No. 17709832.4, dated Jun. 16, 2020, 8 pages.
Intention to Grant received for European Patent Application No. 17709832.4, dated Jan. 13, 2021, 7 pages.
Office Action received for Sri Lankan Patent Application No. 19954, dated Dec. 12, 2019, 1 page.
Notice of Allowance received for Canadian Patent Application No. 3010957, dated Jun. 3, 2021, 1 page.
Office Action received for Canadian Patent Application No. 3010957, dated Oct. 30, 2020, 3 pages.

* cited by examiner

MULTI-LAYERED WOVEN ELEMENT

CROSS REFERENCE TO RELATED APPLICATIONS

This application claims priority to U.S. provisional application Ser. No. 62/277,777, filed Jan. 12, 2016, which is herein incorporated by reference in its entirety.

TECHNICAL FIELD

The present embodiments relate to a multi-layered woven product. More specifically, the present embodiments relate to a multi-layered woven product having a woven graphic image on at least one surface. The present embodiments additionally relate to using different types of weaving materials, weaving processes, and weaving patterns to impart different properties to a woven product.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

The present embodiments provide a woven element having a first plurality of warp threads extending in a first direction, the first plurality of warp threads being integrated into a first surface on a front side of the woven element. The woven element may further include a second plurality of warp threads extending in the first direction, the second plurality of warp threads being integrated into a second surface on a back side of the woven element. A first weft thread may extend in a second direction, where a first portion of the first weft thread is positioned in front of at least one warp thread of the first plurality of warp threads to form at least a portion of a graphic image on the front surface. A second portion of the first weft thread extends between the first plurality of warp threads and the second plurality of warp threads. A second weft thread of the woven element may include a reactive material.

The reactive material may be a thermoreactive material which may have a melting point lower than a melting point of the first weft thread.

The second weft thread may be exposed on the second surface on the back side of the woven element.

The second portion of the first weft thread may extend between the first plurality of warp threads and the second plurality of warp threads for a length extending across three consecutive warp threads of the first plurality of warp threads.

The first weft thread may include a third portion, the third portion being positioned behind at least one warp thread of the second plurality of warp threads to form a tie structure.

The second weft thread may have a backing portion extending the width of the woven element in the second direction, where at least 50% of the backing portion is positioned behind the second plurality of warp threads.

The second weft thread may include a larger denier than the denier of the first weft thread.

The woven element may have a pocket located between the first plurality of warp threads and the second plurality of warp threads.

BRIEF DESCRIPTION OF THE DRAWINGS

Examples are described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Finishing Device

A finishing device may be provided which can dynamically finish one side of a woven product independently of a second side of the woven product. For example, a right side and a left side of a woven article may be finished independently of one another. The sides may be finished in a non-linear fashion, such as an organic geometry, which eliminates the need for at least some post-processing pattern cutting. Additionally, one or more finishing devices of the present embodiments can be dynamically (e.g., moveably) positioned in an interior portion of the woven product as it is being woven. Once positioned, the finishing devices may create apertures, pockets, and/or tunnels in the woven product and finish the edges of these creations. Interior finishing may occur in the direction of the warp and in the direction of the weft.

Figure 1:
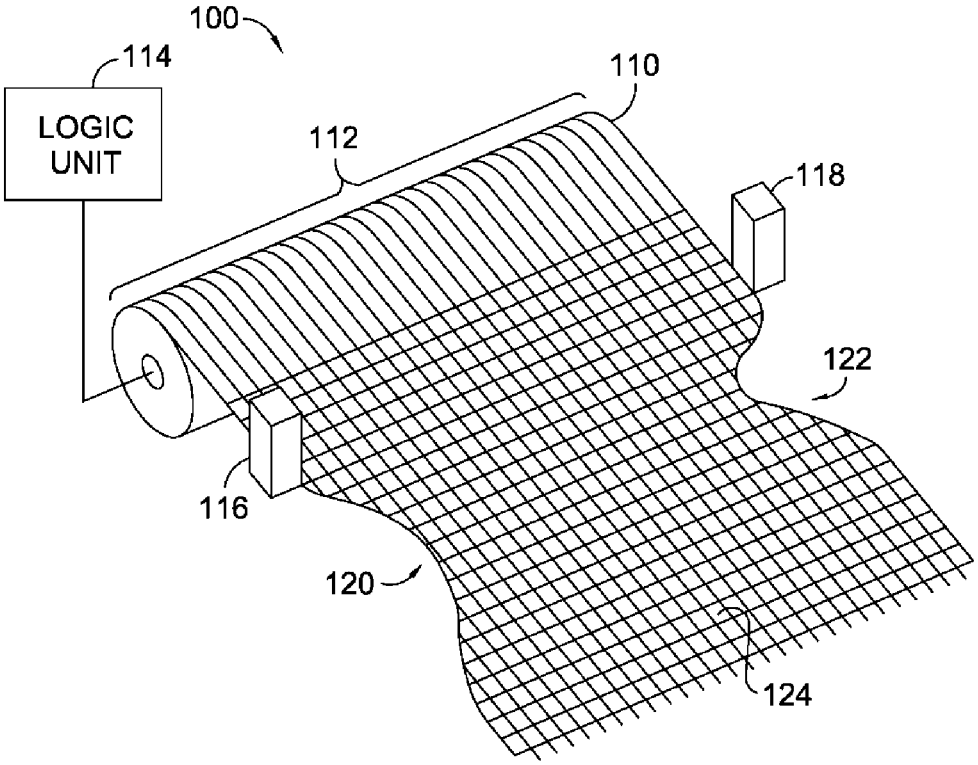
FIG. 1 depicts a top view of a loom with lateral finishing devices in an aspect of the present embodiments.

Turning now to FIG. 1, a top view of a loom 100 is depicted. The loom 100 is exemplary in nature and is used to illustrate certain aspects of one or more finishing devices. The loom 100 may comprise any type of weaving structure. For example, the loom 100 may comprise a Jacquard loom, a Dobby loom, and other looms known in the art.

The loom 100 comprises a beam 110 that holds a set of warp threads 112 in tension. Although the term "thread" is used throughout this Specification for convenience sake, it is contemplated that the term "thread" may comprise any type of material (e.g., thread, yarn, string, braided material, extruded material, pulled material, spun material, and the like) formed from any substance including fabric materials, plastic materials, synthetic materials, metal materials, engineered materials, and the like. The loom also includes a first finishing device 116 and a second finishing device 118 that are positioned along the lateral edges of the loom 100 adjacent to a woven panel 124 (the woven panel 124 comprising warp threads interwoven with weft threads). While only two finishing devices are illustrated with respect to FIG. 1, it is contemplated that any number and combination of finishing devices may be implemented in exemplary aspects. Further, it is contemplated that a finishing device may be oriented in a variety of positions to finish in a variety of manners. For example, a tucker may be oriented to the left to form a right finished edge, or the tucker may be oriented to the right to form a left finished edge. The combination of finishing mechanisms is near limitless when considering types, locations, numbers, and orientations.

The finishing devices 116 and 118 may be manually attached to a supporting frame of the loom (not shown). Alternatively, the finishing devices 116 and 118 may be positioned on one or more positioning mechanisms. The positioning mechanisms may be functional for moving the finishing devices in any direction and/or rotation. For example, the positioning mechanisms may be functional for moving one or more finishing devices in a vertical, horizontal, and/or pivoting manner. In an exemplary aspect, it is contemplated that the positioning mechanism may be comprised of rotating arms that bring the finishing devices 116 and 118 in and out of position on the loom 100 and move the finishing devices 116 and 118 laterally in the direction of the weft threads. The rotating arms may raise and lower the finishing devices 116 and 118 in order to operate on different panels/layers of the woven product. In other contemplated aspects, the positioning mechanism may implement one or more screw drives, conveyors, belts, rapiers, pneumatics, hydraulics, and the like.

With continued reference to FIG. 1, the finishing devices 116 and 118 are used to create a finished edge(s) of the woven panel 124 to create edge stability and prevent fraying of the edges. Edge finishing is important to maintain product integrity during post-weaving processing steps. The finishing devices 116 and 118 may use a tucker or a leno warp twister to create the selvedge or finished edge. Additional ways of creating a finished edge include singeing the edges with a singeing device especially when thermoreactive materials are being woven, and using a sintering laser when chemically-reactive materials are being woven. Other forms of finishing are contemplated, such as ultrasonic, binding, surging, and the like.

The finishing devices 116 and 118 may be programmed to dynamically move laterally in and out of the woven panel 124 (in the direction of the weft threads) as the woven panel 124 is being fed through the finishing devices 116 and 118. The lateral movement of the finishing devices 116 and 118 may be changed with each weft that has been woven. This dynamic movement allows the woven panel 124 to be generated with a finished edge in any possible shape—not just a linear shape—as the woven panel is formed. Vision and/or optical systems may be used in conjunction with the finishing devices 116 and 118 to monitor the lateral movements of the finishing devices 116 and 118 with respect to the woven panel 124.

In an exemplary aspect, it is contemplated that the finishing device operating on one or more wefts finishes the one or more wefts while allowing one or more warps not interwoven with the one or more wefts to maintain continuity. Stated differently, when an organic lateral edge is formed with wefts finished at a location inside the beam width, warp threads will extend from the finished edge toward the lateral edge of the beam. These warp threads may not be terminated until post-processing. The delay in terminating may allow for later woven wefts to utilize these wefts. However, it is also contemplated that warp threads outside the finished edge may be terminated at any point in the weaving process.

The finishing devices 116 and 118 may be programmably-coupled to a logic unit 114 by a wired or wireless connection. The logic unit 114 may execute a pattern program and instruct the finishing devices 116 and 118 based on the pattern program. Further, the logic unit 114 may also be programmably-coupled to the vision and/or optical systems of the finishing devices 116 and 118. The logic unit 114 may receive inputs from the vision and/or optical systems and, based on these inputs, instruct the finishing devices 116 and 118 to move laterally to a predetermined location based on the pattern program. Weaving and finishing the woven panel 124 according to the pattern program reduces the need to manually create the pattern shape after a panel has been woven.

The logic unit 114 may utilize one or more computer readable media having instructions maintained thereon for controlling one or more components. For example, it is contemplated that the logic unit 114 may have a processor and memory functional for executing instructions embodied on the computer readable media, such that by executing those instructions, one or more finishing devices, looms, vision systems, and the like may form a woven article with a finished edge. It is contemplated that a set of instructions identify a location at which a finishing device is to finish a woven article to produce a desired result. The instructions may be stored at the logic unit 114 and/or at a remote computing device, which communicates via a network connection (wired or wireless).

In addition to the logic unit 114, it is contemplated that the finishing mechanism and the positioning mechanism of a finishing device may have one or more computing mechanisms associated therewith. For example, the positioning mechanism may have a microcontroller associated that monitors the position and controls the drive system that operates the positioning mechanism. Similarly, the finishing mechanism may also have a microcontroller associated that controls one or more functions of the finisher. The finishing mechanism microcontroller may be responsible for ensuring components of the finishing mechanism are engaged. Together, a combination of logic unit, microcontrollers, and other components may work in concert to finish one or more edges, including internal edges, without direct human intervention.

The finishing devices 116 and 118 may be programmed to operate independently of each other. The result is a first edge 120 of the woven panel 124 that may have a different shape than a second edge 122 of the woven panel 124. As previously discussed, it is contemplated that the finishing device 116 and the finishing device 118 each have a positioning mechanism that operates independently of each other. As a result, each finishing device may move in a lateral direction that does not directly correlate with the other, when desired.

Figure 2:
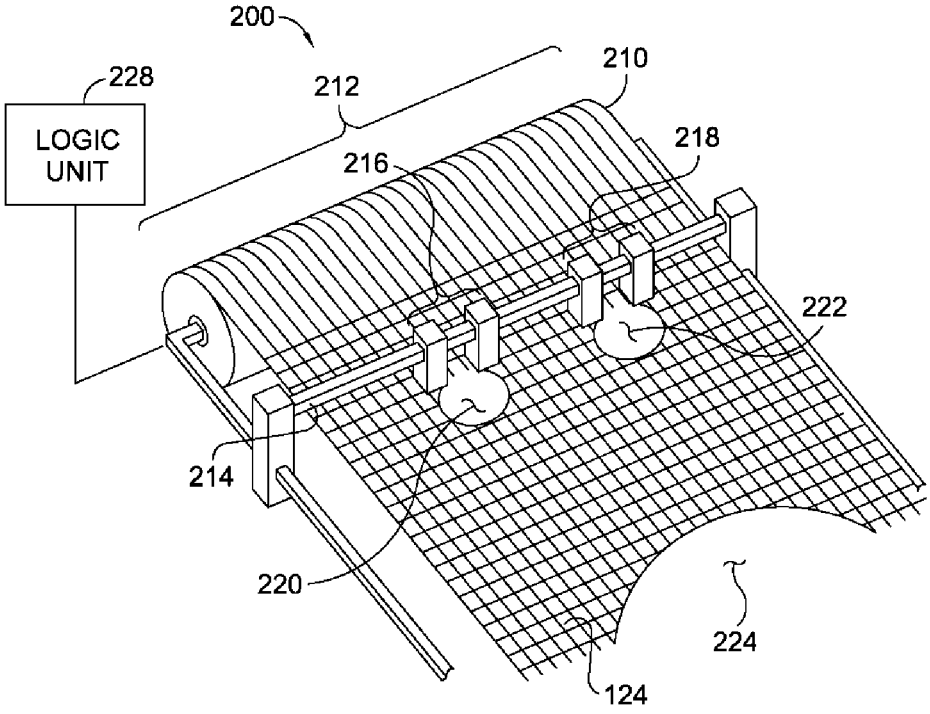
FIG. 2 depicts a top view of a loom with a plurality of interior finishing devices in an aspect of the present embodiments.

Turning now to FIG. 2, a top view of a loom 200 having a plurality of finishing devices located at an interior portion of a woven panel 226 is depicted. The loom 200 is exemplary in nature and is used to illustrate certain aspects of one or more finishing devices. The loom 200 may comprise any type of weaving structure. For example, the loom 200 may comprise a Jacquard loom, a Dobby loom, and other looms known in the art.

The loom 200 comprises a beam 210 that holds a set of warp threads 212 in tension. As previously discussed, the term "thread" is not limiting, but instead used for the convenience of this description. The loom 200 also comprises a support beam 214 mounted to the frame of the loom 200. A first set of finishing devices 216 and a second set of finishing devices 218 are attached to the support beam 214.

The first and second set of finishing devices 216 and 218 may be movable along the support beam 214 through, for example, the use of a screw drive or rollers, as previously discussed. The first and second set of finishing devices 216 and 218 may be able to rotate around the support beam 214 so that the functional aspects of the finishing devices 216 and 218 may be alternately aligned in the direction of the weft threads or the warp threads. Alternatively, one finishing device of the first set of finishing devices 216 may be oriented to operate in the direction of the weft threads (e.g., a tucker), and the second finishing device of the set of finishing devices 216 may be oriented to operate in the direction of the warp threads (e.g., a leno twist); the same holds true for the second set of finishing devices 218. The first and second set of finishing devices 216 and 218 may be able to pivot out of the way when not in use.

In another exemplary arrangement that is not depicted, the first set and the second set of finishing devices 216 and 218 may be mounted on movable arms that act to raise, lower, or laterally move the first and second set of finishing devices 216 and 218. Further, the first set of finishing devices 216 may be operated and moved independently of the second set of finishing devices 218. Although only two sets of finishing devices are shown in FIG. 2, it is contemplated that a plurality of sets of finishing devices may be employed to generate a woven product.

As the loom 200 weaves the woven panel 226, the first and second set of finishing devices 216 and 218 cut and finish warp and/or weft threads to create apertures in the woven panel 226. For instance, as the loom 200 weaves the woven panel 226, the finishing devices 216 and 218 move laterally back and forth along a weft of the woven panel 226. The finishing devices 216 and 218 cut the weft threads and any warp threads 212 that are encountered and simultaneously finish the cut edges of the threads. The cut material may be finished by any of the methods outlined above with respect to FIG. 1 (tucking, leno warp twisting, singeing, sintering, and the like). The sets of finishing devices 216 and 218 may have associated vision and/or optical systems to monitor the lateral movements of the finishing devices 216 and 218 with respect to the woven panel 226. However, as previously discussed, it is contemplated that the weft threads may be cut and finished while maintaining the warp threads for continuity purposes, in an exemplary aspect.

FIG. 2 illustrates two apertures 220 and 222 that are simultaneously being created by the first and second set of finishing devices 216 and 218. As can be seen, the apertures 220 and 222 are finished both in the direction of the warp threads 212 and in the direction of the weft threads. FIG. 2 also illustrates an additional aperture 224 that was created at an earlier point in the weaving process. The aperture 224 was created by one set of finishing devices (216 or 218), thus illustrating that the sets of finishing devices 216 and 218 may operate independently of each other. In this example, a cutting mechanism associated with or independent of the finishing device(s) may terminate (using any known method) those threads that form at least a portion of an internal aperture. For example, it is contemplated that the finishing devices 216 and 216 cut and finish the weft threads and the warp threads that form the internal portion of, for example, the aperture 220. In this example, the finishing devices may not form the aperture 220 until at least one weft has been inserted into the shed of the woven article that will extend across those warps that may be terminated.

The sets of finishing devices 216 and 218 may be programmably-coupled to a logic unit 228 by a wired or wireless connection. The logic unit 228 may execute a pattern program and instruct the sets of finishing devices 216 and 218 based on the pattern program. Further, the logic unit 228 may also be programmably-coupled to the vision and/or optical systems of the sets of finishing devices 216 and 218. The logic unit 228 may receive inputs from the vision and/or optical systems and, based on these inputs, instruct the sets of finishing devices 216 and 218 to move laterally a predetermined distance based on the pattern program. Weaving and finishing the woven panel 226 according to the pattern program reduces the need to manually create the apertures after a panel has been woven. Further, the systems depicted in FIGS. 1 and 2 enable the weaving and finishing of a variety of different patterns including organically-shaped patterns.

The finishing devices discussed above with respect to FIGS. 1 and 2 (i.e., finishing devices 116 and 118, and the sets of finishing devices 216 and 218) may be used on looms with multiple panel weaving capabilities. While weaving multiple panels simultaneously, the finishing devices may create apertures in the interior portion of one or more panels and create different lateral margins on each of the one or more panels. The edges of the apertures and the lateral margins may be finished by the finishing devices. In one aspect, the edges of the apertures may be woven to a corresponding panel(s) that is above or below the panel with the aperture to create one or more channels or pockets.

Figure 3:
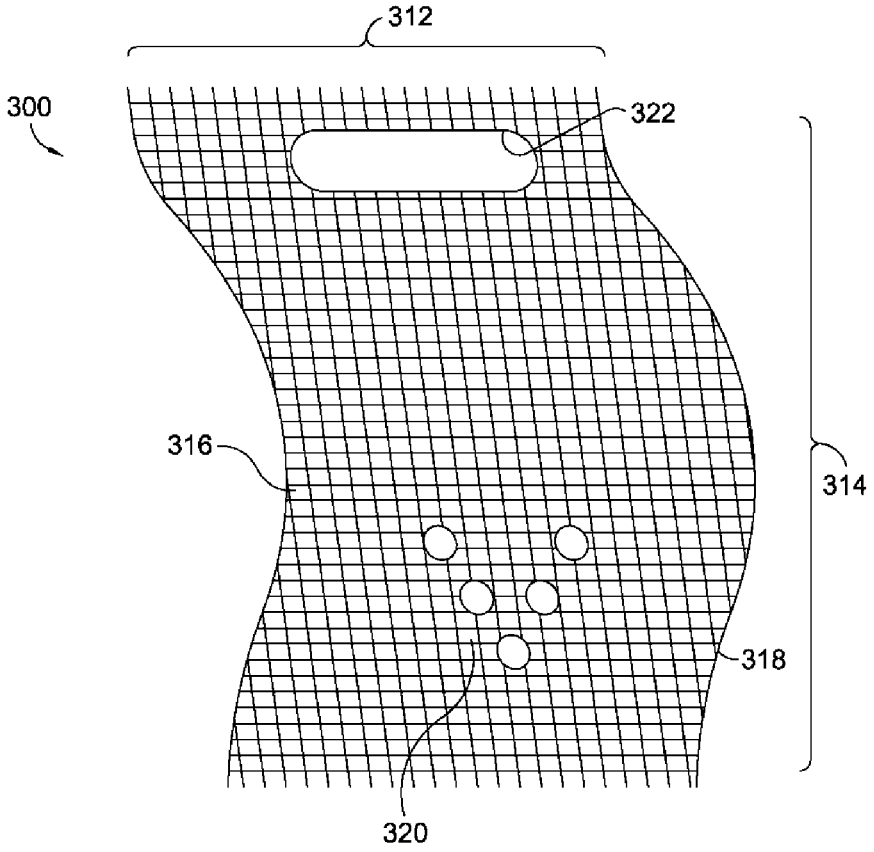
FIG. 3 depicts a portion of an exemplary woven product having lateral finished edges and interior apertures with finished edges in an aspect of the present embodiments.

FIG. 3 depicts a close-up view of a portion of an exemplary woven product 300 that may be produced by the finishing devices discussed above. The woven product comprises a series of warp threads 312 and a series of weft threads 314. Lateral finishing devices, such as the finishing devices 116 and 118 of FIG. 1, may be utilized to create lateral edges 316 and 318 of the woven product 300. The lateral edges 316 and 318 may be organically-shaped or geometrically-shaped. Further, the lateral edge 316 may be shaped the same as or different from the lateral edge 318. The lateral finishing devices may finish the lateral edges 316 and 318 using a tucker, a leno warp twister, a singeing device, a sintering laser, and the like.

Apertures 320 may be created by one or multiple sets of interior finishing devices as discussed above with respect to FIG. 2. The apertures 320 may be small to create a mesh-like pattern, medium-sized to create functional apertures for cording or webbing to pass through, or they can be large allowing pattern parts to separate and connect. The edges of the apertures 320 may be finished. The edges of the apertures 320 may be woven to the edges of apertures in woven panels situated above and below the woven product 300. The weaving together of multiple apertures stacked on top of each other may help to create channels through the woven product 300.

The woven product 300 also comprises an additional aperture 322 that may be constructed by one or more sets of finishing devices. The edges of the aperture 322 may be woven to panels above and below the aperture 322 to create a pocket in the woven product 300. Similarly, a portion of the edges of the aperture 322 may be woven to a panel below the aperture 322 to create an accessible pocket.

Further, it is contemplated that a warp thread separator may be used in conjunction with one or more components of a finishing device. For example, it is contemplated that a warp thread separator may be a wedge-like structure that is inserted between two warp threads that will eventually form the lateral edges of an internal aperture. By forcibly parting two traditionally parallel warp threads prior to (or contemporaneously with) the finishing of weft threads, an aperture may be formed that maintains the continuity of warp threads throughout the warp length of the woven article. It is contemplated that the finishing of the weft threads around each of the separated warp threads maintains the separated warp threads in a desired position, which may be in a non-parallel orientation.

In another exemplary aspect, it is contemplated that a series of finishing devices may be implemented to result in a desired aperture. For example, a leno warp twister may finish a plurality of warp threads in a number of substantially parallel twisted warps. Once the leno warp twister has twisted the warps, another finishing device may be implemented that cuts wefts between two substantially parallel twisted warps and proceeds to tuck each respective new weft end about a proper twisted warp. Further, it is contemplated that a warp separator may separate the two substantially parallel twisted warp groupings as the tucking of the wefts occurs.

A hubless leno warp twister is contemplated as being positioned on one or more internal (medial of the lateral-most warp threads) warp threads. In this example, when an aperture is desired at an internal position of the woven article, the hubless leno warp twister may be positioned on the corresponding warps that are positioned in the lateral direction of the aperture. In this example, the finishing device may include a tucker and a cutter that are functional for forming an aperture between the twisted warp groupings.

Figure 4:
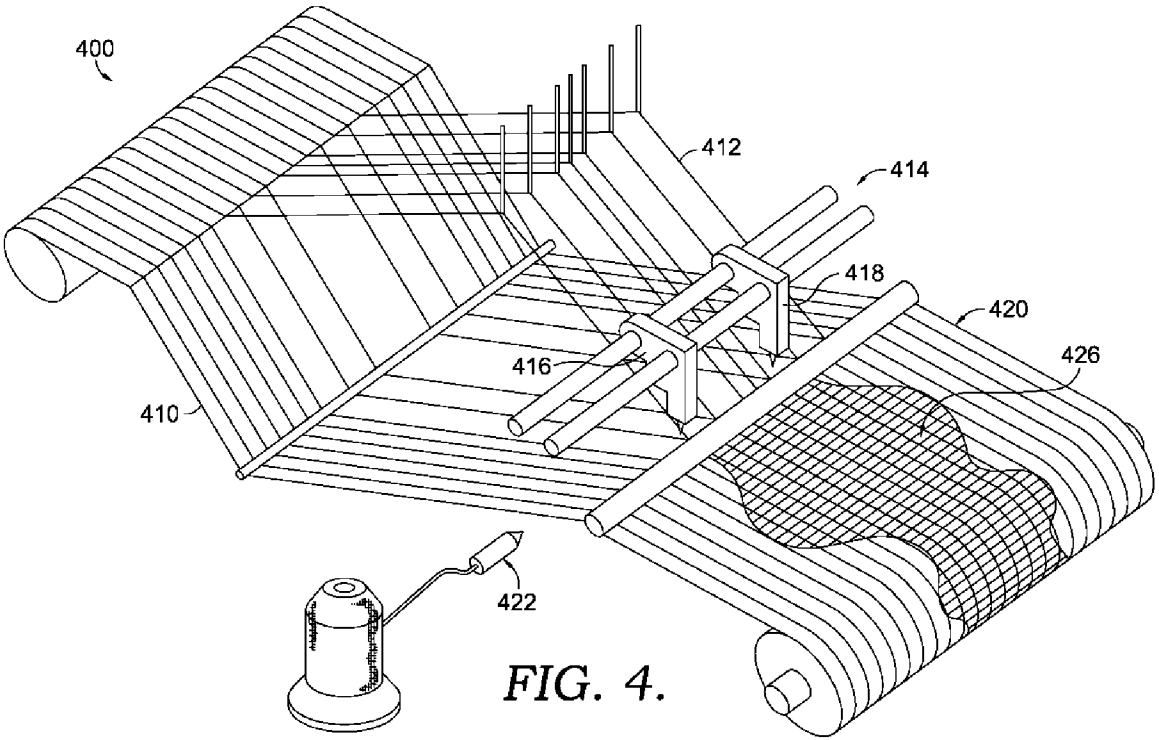
FIG. 4 depicts a loom with lateral finishing devices in an aspect of the present embodiments.

FIG. 4 depicts a top view of a loom 400 having a plurality of finishing devices and a Jacquard device, in accordance with aspects of the present embodiments. The loom 400 is comprised of a warp beam constructed with a plurality of warp threads (e.g., warp threads 410 and 412). The warp threads may be selectively positioned up or down based on manipulation by Jacquard needles 424. In the present illustration, only those Jacquard needles maintain warps in an up position are illustrated, but it is contemplated that even those warps in the down position also are associated with Jacquard needles. The loom 400 incorporates a first finishing device 416 and a second finishing device 418. The finishing devices are positionable dynamically using a positioning mechanism 414. As illustrated in this exemplary aspect, the positioning mechanism is comprised of two rods, which may be screw drives. For example, it is contemplated that the first finishing mechanism 416 is actively engaged to a first of the two rods and passively engaged with the second rod. Similarly, it is contemplated that the second finishing mechanism 418 is actively engaged with the second of the two rods and passively engaged with the first rod. When actively engaged with a rod, the rod is functional to move the finishing device laterally (or pivotally). When passively engaged, the finishing mechanism may be allowed to be supported by the rod, but not actively positioned by that rod.

As depicted in FIG. 4, warp threads that are not interwoven with weft threads to form a portion of a woven article 426 may be left in a down position (or any position) when a weft thread, as provided by a weft loader 422, is being inserted into the warp threads. Further, it is contemplated that the warp threads not interwoven with weft threads (e.g., warp thread 420) may be allowed to maintain continuity for the length of the weaving process to ensure consistent tension and other characteristics. As such, it is contemplated that the warp threads not interwoven with weft threads may be separated from the woven article 426 in a post-processing procedure. Further, the non-interwoven warp threads may be removed at the time of forming the woven article 426, in an exemplary aspect.

In the illustrated aspect of FIG. 4, the finishing devices 416 and 418 are positioned proximate the weft insertion place; however, it is contemplated that one or more of the finishing devices may be positioned at any location. For example, a warp finishing device may be positioned prior to the insertion of the weft thread. Further, it is contemplated that a weft finishing device may be positioned at a location post-weft insertion and weft packing. Therefore, one or more finishing devices may be located at any location along the formation of a woven article.

As previously discussed, it is contemplated that a number of possible internal apertures may be formed using one or more finishing devices. For example, FIGS. 5-11 illustrate various arrangements and techniques for forming an aperture in an internal portion of a woven article, in accordance with aspects of the present embodiments.

Figure 5:
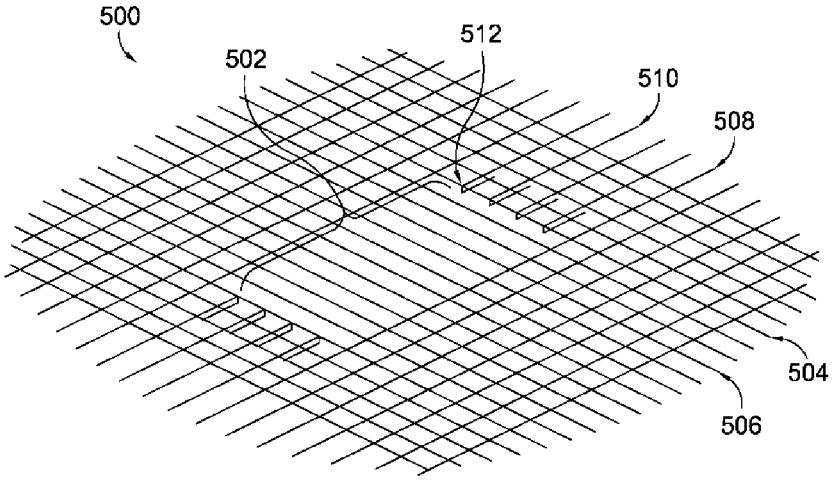
FIGS. 5-11 depict exemplary portions of a woven articles comprised of internal apertures formed, at least in part, with one or more finishing devices, in accordance with aspects of the present embodiments.

FIG. 5 depicts a portion of a woven article 500 comprised of an internal aperture 502, in accordance with aspects of the present embodiments. The aperture 502, in this example, is formed by finishing one or more weft (i.e., fill) threads to form a portion of the aperture 502 perimeter. In this illustration, a series of warp threads, such as a warp thread 504 and a warp thread 506 extend through the woven article 500. The warp threads are interwoven with a series of weft threads. A portion of the weft threads, such as weft thread 510, are finished at an internal portion of the woven article. Other weft threads, such as a weft thread 508 extend the length of the warp beam, in this example.

The aperture 502 is formed by finishing (e.g., tucking) the weft threads that would otherwise cross a desired internal aperture. For example, the weft 510 is tucked around the warp 504 at a tuck 512. The finishing may occur during the weaving process (e.g., prior to packing by a comb, subsequent to packing by a comb) and/or the finishing may occur as a post-process procedure. The aperture 502 is formed with substantially linear perimeter edges. Other apertures discussed herein (e.g., an aperture 602 of FIG. 6) may have gradient edges on the perimeter. It is contemplated that any form of finishing may be implemented on the warps and/or the wefts (and in any combination). For example, the various threads may be finished with a fold and weld process, a tucking process, a singeing process, an activation process (e.g., heat activation), and other finishing techniques discussed herein.

Figure 6:
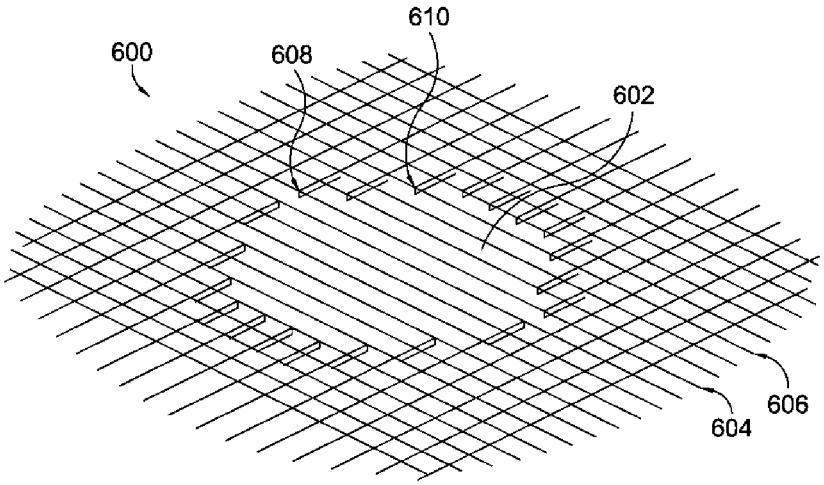

FIG. 6 depicts a portion of a woven article 600 comprised of an internal aperture 602, in accordance with aspects of the present embodiments. The article 600 is formed with a plurality of warps, such as warps 604 and 606. The article 600 is also formed with a plurality of wefts, such as wefts 608 and 610. The aperture 602 is formed having a gradient perimeter (e.g., semi-circular in appearance). This gradient perimeter may be accomplished by adjusting which of a plurality of warps onto which a weft extends. For example, the weft 608 extends farther than the weft 610, forming a graduated perimeter of the aperture 602. In this example, the warps continue to extend through the aperture 602; however, it is contemplated that the warps extending into the aperture 602 may be removed by one or more finishing techniques discussed herein. The warp removal may occur at any point after a subsequent weft is interwoven with the to-be-finished warp, in an exemplary aspect.

Figure 7:
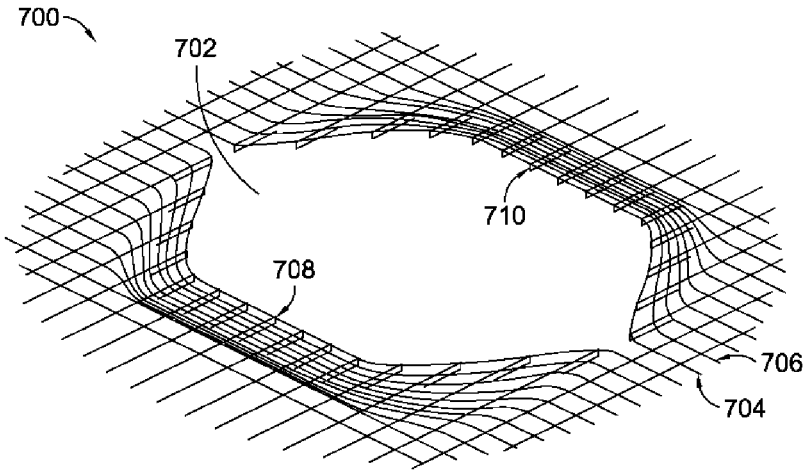

FIG. 7 depicts a portion of a woven article 700 comprised of an internal aperture 702, in accordance with aspects of the present embodiments. The internal aperture 702 is formed, in this example, through the pulling of the warp threads that would otherwise transverse the aperture to a side of the aperture. The pulling of the warp threads may be accomplished using a lateral-moving heddle, a warp separator (discussed hereinabove), and/or a weft tensioning process. The weft tensioning process may exert a lateral force that draws or pulls one or more warps away from an aperture to be formed. This force may be exerted as the weft is being finished to prevent an excess material accumulation. Further, it is contemplated that the weft may be pulled from a lateral edge after the finishing process is applied (and potentially prior to packing by a comb). Other exemplary aspects are contemplated.

The moveable warp concept is exemplified in FIG. 7 having a plurality of warps, such as warps 704 and 706. The warps are interwoven with a plurality of wefts, such as weft 708 and 710. The weft 708 is finished on a left side of the aperture 702 and the weft 710 is finished on the right side of the aperture 702 proximate the warp 704. The wefts maintain the warps that would otherwise traverse the aperture 702 in an offset location allowing for the formation of the aperture 702 with minimal finishing of the warps. In this example, the warps may not need a finishing process done, which may aid in maintaining the continuity of the warps through the length of the woven article 700.

Figure 8:
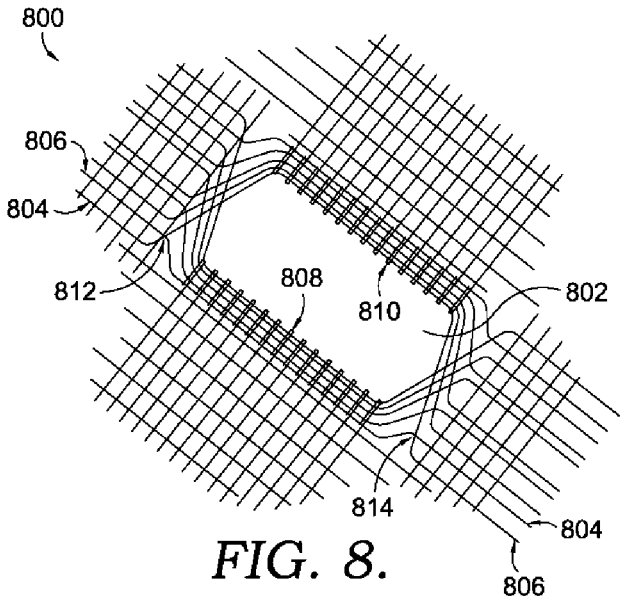

FIG. 8 depicts a portion of a woven article 800 comprised of an internal aperture 802, in accordance with aspects of the present embodiments. The aperture 802, in this example, is contemplated as being formed using a series of leno twist-like operations on one or more of the warp that would otherwise traverse the aperture 802. For example, a warp 804 and a warp 806 are initially twisted at a location 812 prior to diverging to opposite sides of the aperture 802. The warps 804 and 806 are then again twisted at a location 814 at a distant end of the aperture 802. The twisted warps are maintained in a separated position with one or more finished wefts, such as wefts 808 and 810. It is contemplated that any number of twists may be implemented prior to or following the aperture 802.

Figure 9:
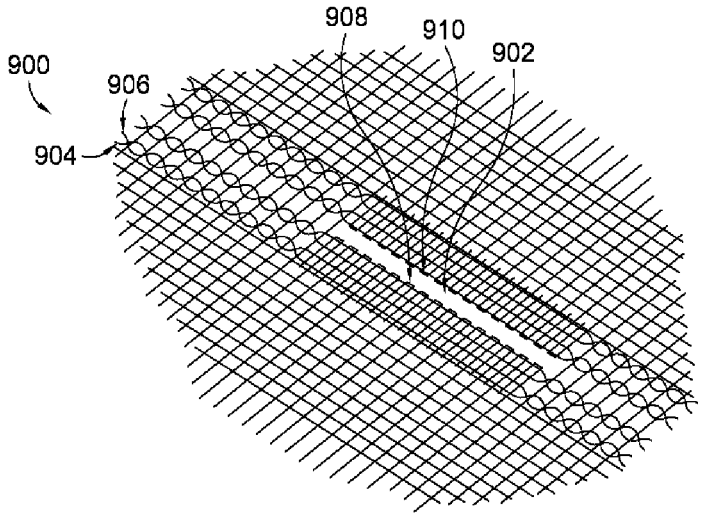

FIG. 9 depicts a portion of a woven article 900 comprised of an internal aperture 902, in accordance with aspects of the present embodiments. The internal aperture 902, in this example, is formed having one or more twisted pairs of warps forming the lateral perimeter of the aperture 902. For example, it is contemplated that a leno warp twist process is applied to a warp 904 and a warp 906. While the twisting is not illustrated as continuing along the perimeter of the aperture 902, other aspects may implement a twist in conjunction with one or more wefts finished to form the aperture 902. Further, it is contemplated that a twist process may begin at any point during the weaving process and is not required, in an exemplary aspect, to continue along the length of the woven article. Stated differently, a twist of two or more warps may commence at any weft and may terminate at any weft. A first side of the aperture is formed with a termination of a weft 908 and a second side of the aperture is formed with the termination of the weft 910.

Figure 10:
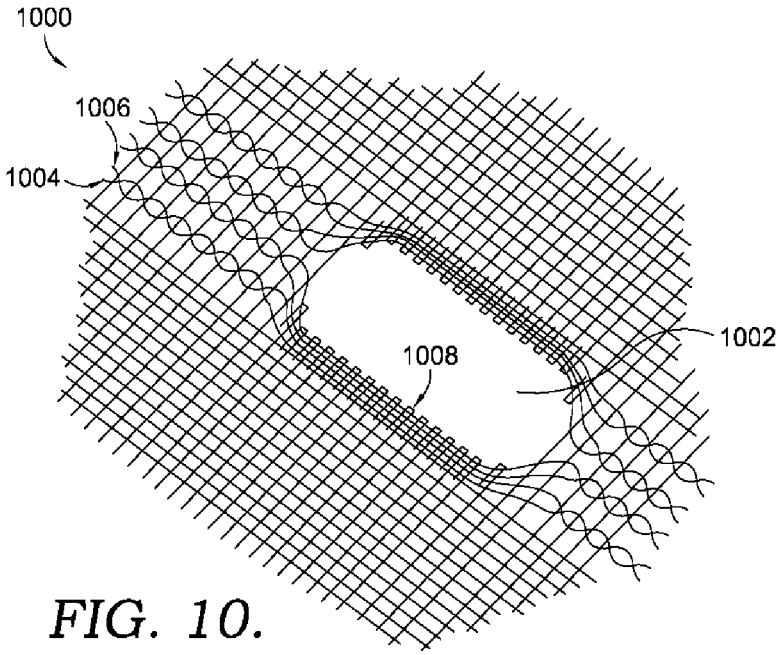

FIG. 10 depicts a portion of a woven article 1000 comprised of an internal aperture 1002, in accordance with aspects of the present embodiments. The aperture 1002 may be formed in manner similarly discussed with respect to FIG. 9. However, unlike that which is depicted in FIG. 9, the aperture 1002 is formed with a separating of two or more twisted warps, which may then be maintained in a separated position with one or more wefts, such as a weft 1008. As discussed with respect to FIG. 7, it is contemplated that a number of mechanisms may be implemented for moving the warp threads from their aligned position to an offset position. For example, it is contemplated that a warp separator, a laterally moveable heddle, and/or a weft tension force may be implemented to move the one or more warp to an offset position, which creates, at least in part, the aperture 1002.

It is contemplated that an aperture may have any shaped perimeter. For example, multiple curves having varied radii in various directions (e.g., different sized concave and convex-oriented curves) may be formed as a portion of the perimeter. Further, an aperture may be formed using any combination of techniques discussed herein. For example, a leno warp twist may be used to form one portion of the perimeter and an alternative technique may be used to form another portion of the perimeter, in an exemplary aspect.

Figure 11:
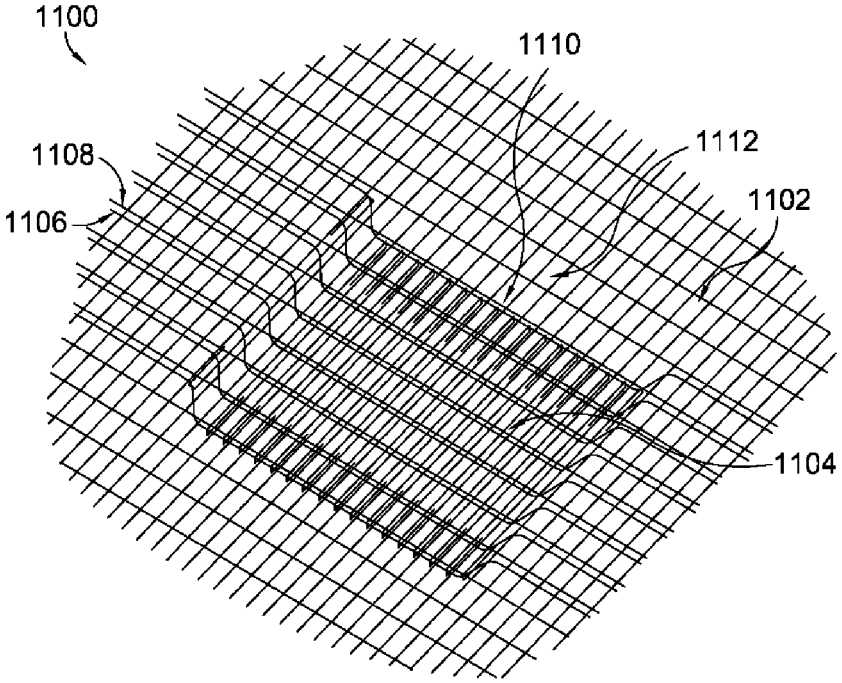

FIG. 11 depicts a portion of a woven article 1100 comprised of two layers 1102 and 1104, in accordance with aspects of the present embodiments. The first layer 1102 may extend in a substantially planar manner while the second layer 1104 may deviate from the first layer 1102 to form a channel or pocket. For example, it is contemplated that a first warp 1108 form a portion of the first layer 1102. And a second warp 1106 is pulled down to form a portion of the second layer 1104. This two-layer approach may allow for a channel through which a material may pass (e.g., webbing, thread, yarn, clips, and the like). Similarly, it is contemplated that the wefts may extend from the first layer to the second layer at one end of the channel to form a pocket-like enclosure. The open end of the pocket-like enclosure may be finished in one or more techniques provided herein.

As depicted in FIG. 11, a weft 1112 is interwoven with one or more warps forming the first layer 1102. A weft 1110 is interwoven with one or more warps forming the second layer 1104. While the weft 112 may be woven in a traditional manner, it is contemplated that the weft 1110 may be finished at one or both ends to form a pocket or channel respectively.

Figure 12:
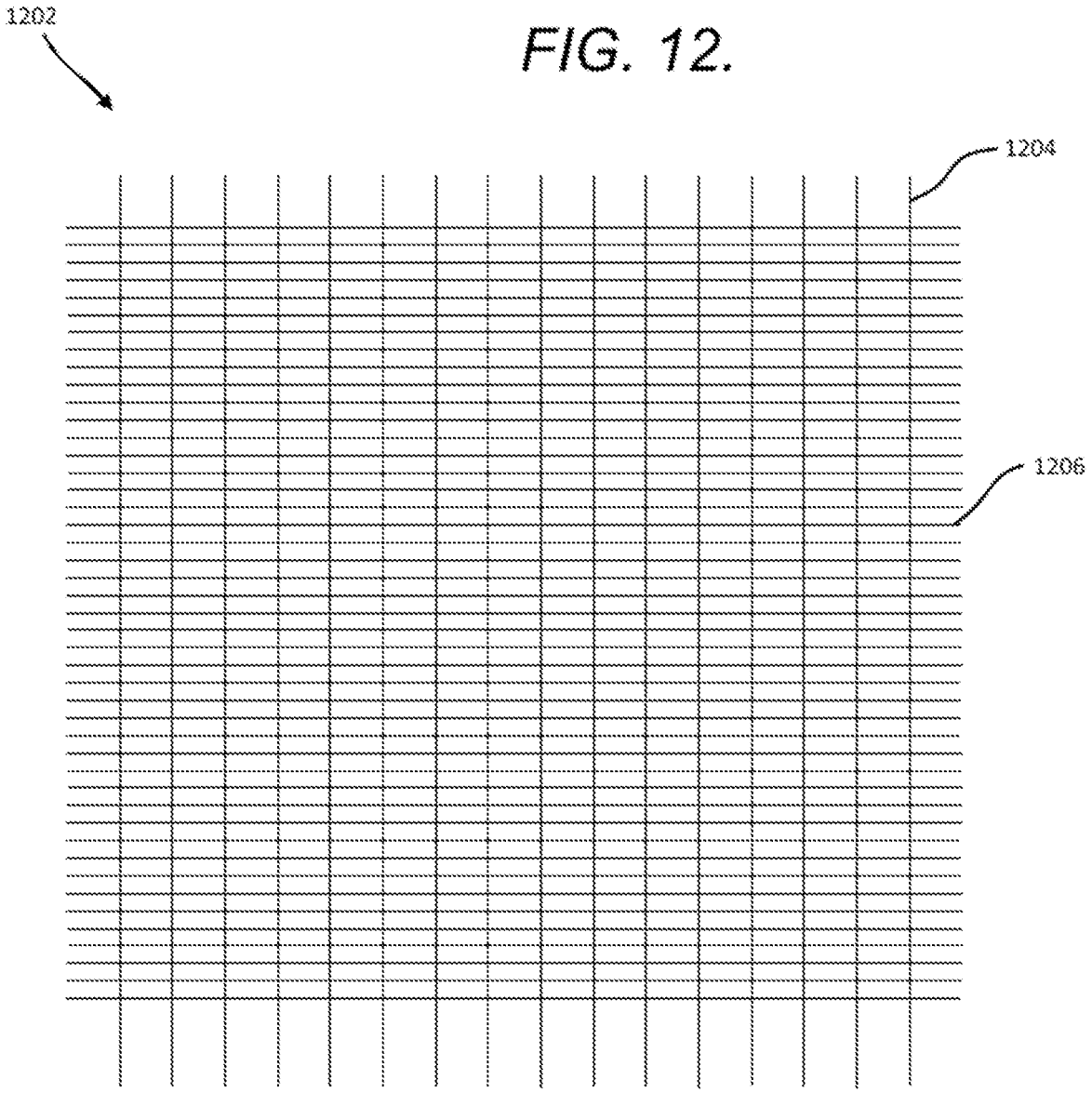
FIG. 12 depicts an exemplary woven element with substantially more weft threads per inch than warp threads per inch.

Articles with Variable Number Warp Threads, Reactive Weaving Materials, and Weaving Methods In FIG. 1 through FIG. 9, the woven materials are depicted as having about the same number of warp and weft threads per inch. However, in practice, and turning now to FIG. 12 (which is not intended to be to scale), a single woven article 1202 often has a substantially different density with respect to the warp threads and the weft threads. For example, as depicted, the woven element 1202 may have substantially more weft threads 1206 per inch than warp threads 1204 per inch (or vice-versa). In a more specific, non-limiting example, a woven element incorporating a high-resolution graphic image on one surface (as described in detail below) may have a pick count (measured in weft threads per inch) of approximately 5,000 and an end count (measured in warp threads per inch) of approximately 288 (such as when a 288 Satin Broadloom is used). The number of warp threads and weft threads per inch may vary at different locations of the woven element 1202.

Although the term "thread" is used for convenience sake, it is contemplated that the term "thread" may comprise any type of material (e.g., thread, yarn, webbing, braid, filaments, fibers), which may be formed from any type of substance including fabric materials, plastic materials, synthetic materials, metal materials, extruded materials, organic materials, engineered materials, and the like.

In some embodiments, and as described in detail below, the incorporation of multiple layers may allow for a woven article that can exhibit different characteristics at different surfaces. For example, one layer or surface resulting from coarser (e.g., larger denier) threads may have greater abrasion resistance and tensile strength characteristics, which may be better suited for an exterior surface of an article. Complementary, a layer or surface comprised of finer threads (i.e., smaller denier) may allow for a better skin contacting surface and therefore be suited for an interior article surface. Further yet, the finer threads may also be more suitable for forming woven graphical surfaces because a higher resolution may be achieved with the finer threads. As a result, the finer thread layer may be suitable for a location at which graphics are intended to be incorporated. These characteristics may result in a number of layer combinations that provide different characteristics (e.g., finer thread interior surface, a coarser thread internal layer for structure, and a finer thread exterior for graphical integration).

Figure 13:
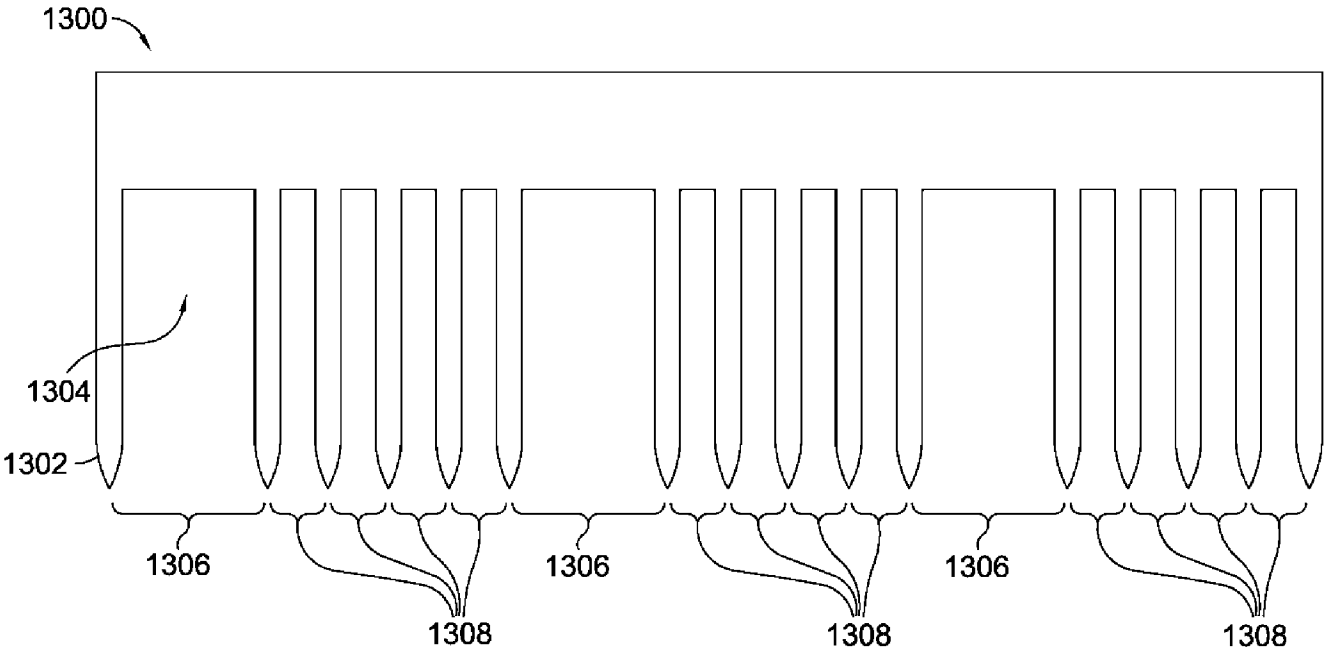
FIG. 13 depicts an exemplary loom beater used in conjunction with a multi-layered woven articles in an aspect of the present embodiments.

Turning to FIG. 13 illustrating an exemplary loom beater 1300 used in connection with a single or multi-layered woven article, in accordance with aspects of the present embodiments. The loom beater 1300 is comprised of a plurality of reeds 1302 extending the length of the loom beater 1300. A slot that is formed between each of the reeds is referred to herein as a dent 1304. Typically a warp thread will extend through the dent 1304 so that the reeds 1302 may pack the wefts in the woven article. In this illustrated example, the size of the dents 1304 is not consistent across the length of the beater 1300.

A typical beater has a uniform dent that is selected based on the warp thread characteristics. However, in aspects contemplated herein, two or more warp threads may be packed simultaneously. In the illustrated example, there are four smaller dents 1308 between each larger dent 1306, which results in a 4:1 ratio of smaller denier warp threads to larger denier warp threads being packed simultaneously. This ratio may be adjusted based on the thread count of the various warp beams being simultaneously packed by the beater. In this example the finer warp thread may have a four times the thread count as the coarser warp thread. Any ratio and any ordering of dents (size of slot) are contemplated to effectively pack a weft when two or more warp materials are utilized. Other exemplary arrangements of beaters are contemplated.

Figure 14:
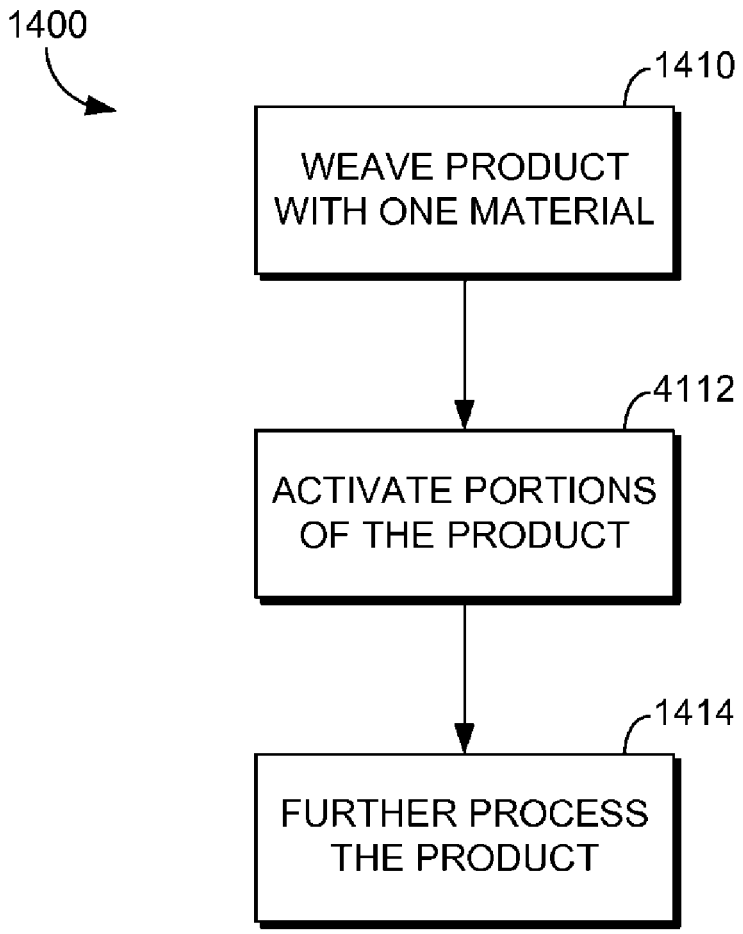
FIG. 14 depicts an exemplary flow diagram of a method of weaving using reactive materials in an aspect of the present embodiments.

The aspects of the present embodiments are also directed toward weaving using reactive materials. FIG. 14 depicts a block diagram illustrating an exemplary method 1400 for weaving using reactive materials, in accordance with aspects of the present embodiments. The term "reactive material" is meant to encompass a wide variety of materials. For instance, the weaving materials may be water soluble, etchable, thermoreactive, moldable, fusable, and the like. Further, the weaving materials may be coated with different types of materials to produce a core and an associated sheath. The core and/or the sheath may have different reactive and/or aesthetic properties. By way of illustrative example, the sheath may be water soluble, and the core may be water resistant. Alternatively, the sheath may be water resistant (while potentially being water permeable), and the core may be water soluble. In another illustrative example, the sheath may be one color and the core may be a second color. Products woven with these reactive materials may be processed to produce certain aesthetic properties and/or certain functional properties. The processing may occur while the product is being woven, or it may occur as a post-weaving processing step.

At a block 1410, a product is woven with one material. The material may have reactive characteristics as outlined herein. Alternatively, the material may not have reactive characteristics. As will be discussed hereinafter, it is contemplated that an intermittent splicer may be utilized to insert a particular reactive material at a defined location within the woven article.

The weaving of a product with a material with reactive characteristics may include a material that prior to a reaction has a low stretch coefficient (e.g., a polymer-coated elastic material, where the polymer coating prevents the elastic properties of the core from being experienced). Following the reaction of the material, the underlying characteristics may be experienced. Therefore, traditional weaving techniques and equipment may be utilized that traditionally relies on a lower elasticity, but the resulting woven product may exhibit the elasticity property (at least in desired locations) by removing the restrictive sheath.

At a block 1412, selective portions of the woven product are treated or activated. In one aspect, activation or treatment may occur as the product is being woven. For instance, different activating devices such as a water jet, a heat device, a sintering laser, ultrasonic waves, chemicals, and the like may be applied to selective portions of the product while it is still on the loom. In another aspect, the activating mechanisms may be applied to selective portions of the product after weaving is complete and the product has been removed from the loom. In one example, selective portions of the product are treated with, for example, a mask. The mask may prevent the activation of the reactive material in defined locations that are desired to maintain the as-woven characteristics. Alternatively, the masked portion may determine the location at which the reactive material is activated.

Depending on the properties of the weaving material, activation of selective portions of the product may produce different functional or aesthetic properties. In one example, activation may cause selective portions of the product to dissolve or be eliminated thus producing apertures or open areas in the product. Activation may cause selective portions of the product to melt slightly and then reform to produce a solid portion in the product. As well, activation may cause selective portions of the product to change color. In another example, activation may cause selective portions of the product to be molded into certain shapes. Many other examples exist and are contemplated.

At a block 1414, further processing of the product may occur. For example, with respect to the treatment of selective portions of the product with a mask at block 1412, the mask may be reactive, and further processing may include activating the masked areas. Alternatively, the mask may be inert and be used to shield selective portions of the reactive materials from activation. In this case, the remainder of the product not covered by the mask may be activated using one or more of the activating devices discussed herein.

Figure 15:
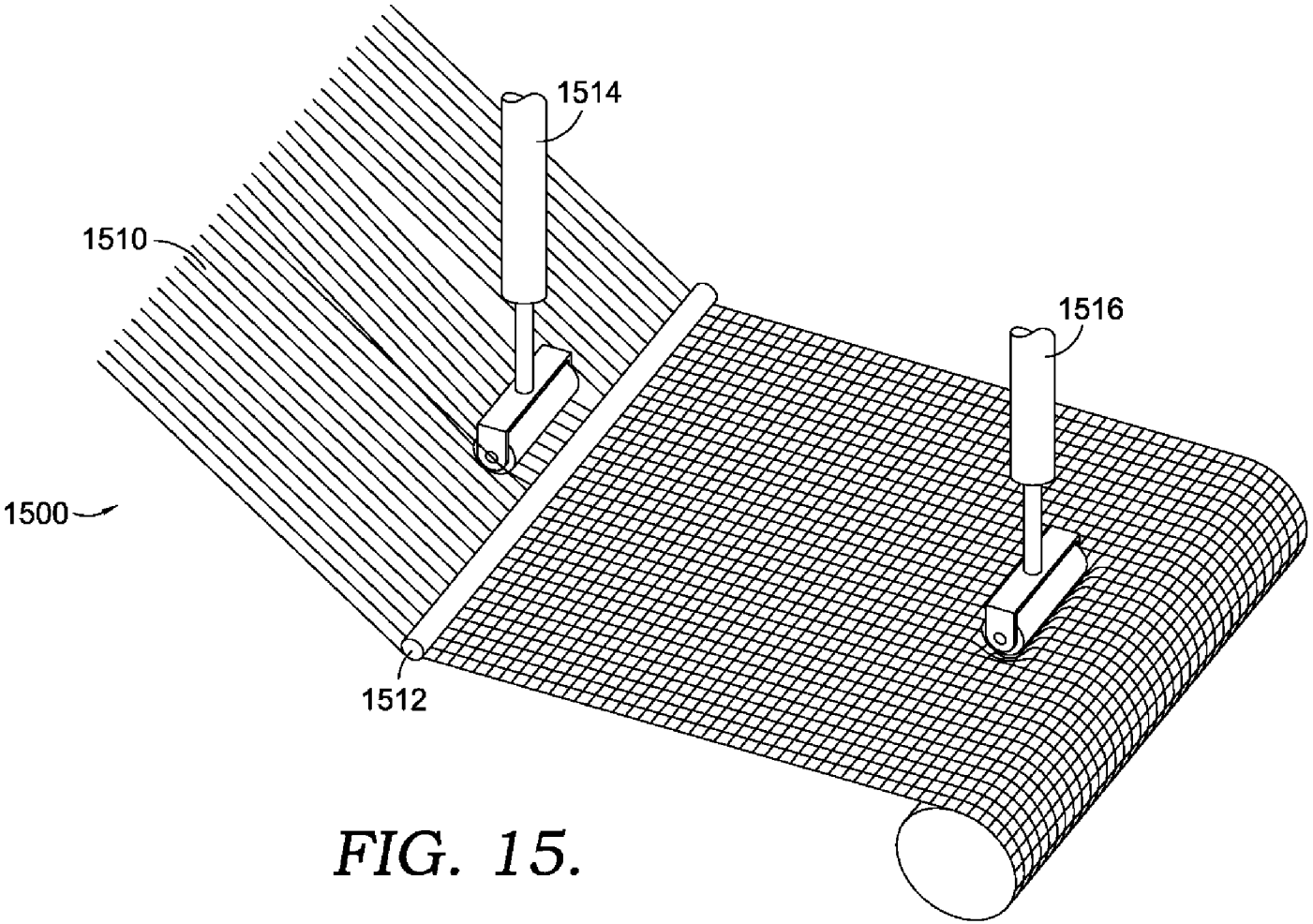
FIG. 15 depicts an apparatus for introducing three-dimensional effects to a panel as it is being woven in an aspect of the present embodiments.

FIG. 15 depicts an apparatus for introducing a three-dimensional (3-D) effect into a product as it is being woven. FIG. 15 includes a loom 1500, a set of warp threads, 1510, a weft insertion point 1512, a first 3-D effector 1514, and a second 3-D effector 1516. The loom 1500 may comprise any type of weaving structure. For example, the loom 1500 may comprise a Jacquard loom, a Dobby loom, and other looms known in the art.

The first and second 3-D effectors 1514 and 1516 may be attached to one or more adjustable arms that act to move the 3-D effectors 1514 and 1516 laterally back and forth across the width of the panel and/or vertically to introduce changes in tension and excess in material. The first and second 3-D effectors 1514 and 1516 may also be attached to a support beam and moved by, for example, a screw drive or rollers. Further, the first and second 3-D effectors 1514 and 1516 may be pivoted out of the way when not needed. The contact head of the first and second 3-D effectors 1514 and 1516 may comprise any shape such as a cylinder, an ellipse, etc. The shape of the material contacting surface may determine the resulting 3-D form that results in the woven product. Although only two 3-D effectors are shown, it is contemplated that multiple effectors may be positioned across the width of the panel and at any location in the warp direction.

The first 3-D effector 1514 acts to increase the tension on the set of warp threads 1510 in select places along the width of the panel immediately prior to introducing the weft threads at the weft insertion point 1512. The weft threads are subsequently introduced at the weft insertion point 1512. The tension on the warp threads 1510 is maintained by the second 3-D effector 1516 as additional weft threads are inserted and the weft is packed. By maintaining increased tension on the set of warp threads 1510 during the insertion and packing of the weft threads, the deformity produced by the first and second 3-D effectors will be "locked" into place.

Further, it is contemplated that one or more 3-D effectors are positioned on the loom after the weft insertion point 1512, but prior to a loom beater that packs the weft. As such, the weft may be inserted in a substantially linear manner, as is typical, but before the weave is packed and "locked" into place, the 3-D effector increases the tension on one or more warps (and the inserted weft(s)). This increased tension may produce an excess in material at the location of the 3-D effector, which once the beater packs the weft, is maintained. This process may introduce deformations to an otherwise planar-type woven article. It is contemplated that the lateral position and the vertical position of one or more 3-D effectors may be dynamically altered during the weaving process, which may result in an organic three-dimensional form being introduced into the woven article.

While the 3-D effectors are depicted pressing in a common downward orientation, it is contemplated that a 3-D effector may exert a pressure in any direction at any location, and in any combination. Further, it is contemplated that any number and any position of a 3-D effector may be implemented.

Intermittent Weaving Splicer and Dynamic Tensioner

Figure 16:
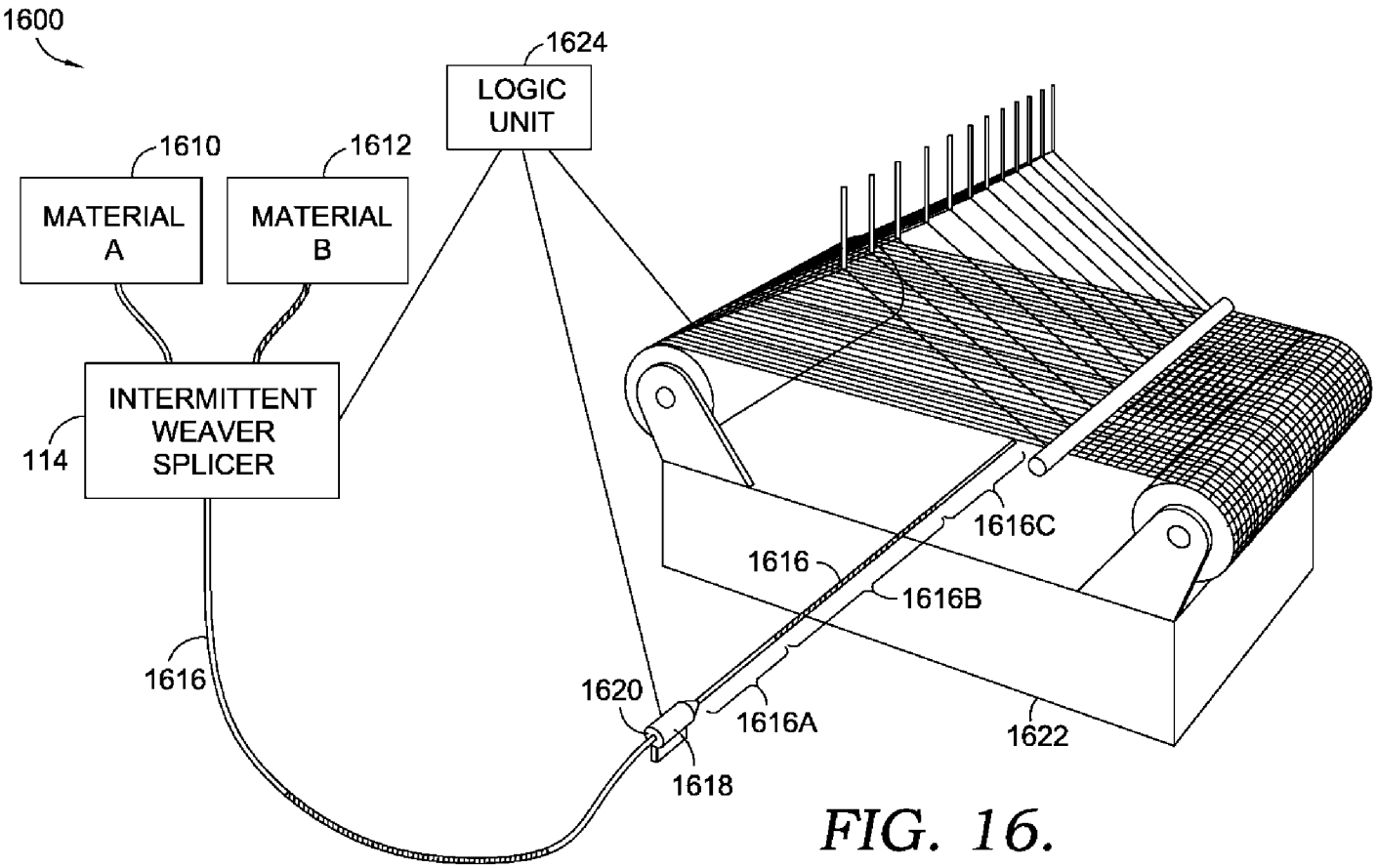
FIG. 16 depicts an exemplary intermittent weaving splicer within an exemplary weaving system in an aspect of the present embodiments.

FIG. 16 illustrates a system 1600 that comprises an intermittent weaving splicer 1614, a dynamic tensioner 1620, a feeding component 1618, a loom 1622, and a logic unit 1624. However, it is contemplated that additional components may be implemented in conjunction (or independently) with those depicted herein in exemplary aspects. Further, it is contemplated that any number of those components depicted, discussed, or implied in connection with FIG. 16 may also be implemented in exemplary aspects.

The intermittent splicer 1614 may receive two or more materials such as material A 1610 and material B 1612 through one or more input ports. As used herein, a material received by the intermittent splicer 1614 may include, for example, yarn, thread, webbing, strands, braids, and the like. Further, it is contemplated that the material may be formed, at least in part, with organic substances (e.g., cotton, rubber), polymer-based substances (e.g., nylon, polyester, synthetic rubber), metallic-based substances (e.g., copper, silver, gold, aluminum), and other engineered materials (e.g., aramid synthetic fibers, carbon-fiber, fiber glass). The material is also contemplated having varied physical characteristics (as will be discussed hereinafter). For example, the material may have varied diameter, elasticity, abrasion resistance, chemical reactivity traits, tension modulus, tensile strength, moisture absorbance, and the like.

The material A 1610 and the material B 1612 may comprise different types of materials. For instance, the materials 1610 and 1612 may differ in diameter, density, color, functional properties, aesthetic properties, mode of manufacture (extrusion, spun, molded, etc.), treatments applied to the materials 1610 and 1612, and so on. Functional properties may comprise elasticity, stiffness, water solubility, thermoreactivity, chemical reactivity, and the like. Treatments applied to the materials 1610 and 1612 may comprise water proofing, wax coating, and/or applying coatings that impart a matte, luster, reflective, or shiny finish to the materials 1610 and 1612. Treatments may also comprise reactive coatings that may react with water, heat, chemicals, and the like. Additionally, it is contemplated that a multi-substance material is used. A multi-substance material may be a material having an outer sheath of a different substance than an interior core. In this example, the outer sheath may impart certain characteristics to the multi-substance material that differ from the internal core. For example, the internal core may have a high elasticity and the outer core may be a reactive coating that prevents the stretch of the multi-substance material. Therefore, as will be discussed hereinafter, it is contemplated that portions of the outer core may be selectively removed (e.g., reactively removed by chemical means or light, for example) to allow the properties of the inner core to be exhibited in those portions where the outer core has been removed. Alternative arrangements of a multi-substance material are contemplated (e.g., reactive core, reactive fibers intertwined with non-reactive fibers).

Returning to FIG. 16, in an exemplary aspect, the intermittent splicer 1614 may receive material A 1610 through a first input port (not shown) and material B 112 through a second input port (not shown). Alternatively, material A 110 and material B 1612 may be received through a single input port. Although only two materials are depicted in FIG. 16, it is contemplated that the intermittent splicer 1614 may receive any number of materials. In an exemplary aspect, it is contemplated that the material is maintained by a spool-like structure for feeding into the intermittent splicer 1614 for effective receipt.

The intermittent splicer 1614 receives material A 1610 and material B 1612. After being received by the intermittent splicer 1614, the materials may be fed through a measuring component (not shown) that measures predetermined distances of the materials 1610 and 1612. The measuring component may comprise a toggle wheel, a timing system that measures the rate at which the materials 1610 and 1612 are being received, a caliper system, and/or a vision or optical system to measure the predetermined distances/lengths of a material. After predetermined distances have been measured for material A 1610 and/or material B 1612, the intermittent splicer 1614 may be programmed to terminate material A 1610 and/or material B 1612 at predefined distances.

The intermittent splicer 1614 may use mechanical means such as a knife to terminate (e.g., cut) the materials 1610 and/or 1612. As well (or in the alternative), the intermittent splicer 1614 may use a laser, air, ultrasound, water, heat, chemicals, and the like to terminate the materials 1610 and/or 1612 at defined lengths. Therefore, it is contemplated that the intermittent splicer 1614 is functional to terminate a continuous run of material at an intermediate point in the run. For example, a material may be maintained on a spool that has several hundred feet of continuous material prepared to be fed through the intermittent splicer 1614. In this example, the intermittent splicer 1614 may terminate the material at any point along the length of the several hundred feet of continuous material (any number of times). As a result, any desired length of material may be used at any portion of a resulting combined material resulting from the intermittent splitter 1614.

The intermittent splicer 1614 may be mechanically operated by one or more mechanisms controlled by the logic unit 1624. For example, it is contemplated that the intermittent splicer 1614 may, without intervention from a human operator, terminate a material using an electro-mechanical mechanism (e.g., an actuator, pneumatic, hydraulic, motor) and/or the like. By controlling the terminating portion of the intermittent splicer 1614 by the logic unit 1624, an automated system may be implemented that once started, may not require intervention by a human to manufacture an article having a variety of materials strategically located in a common weft pass (or warp).

Once terminated, the materials 1610 and 1612 may be joined together by the intermittent splicer 1614 to create a combined material 1616. Traditional methods of joining materials 1610 and 1612 together such as fraying the ends of materials 1610 and 1612 and joining the frayed ends may be employed. For example, the materials to be joined may be comprised of a plurality of fibers that when separated (e.g., frayed) at each respective end may then be intermeshed together to form an effective bond between a first end of a first material and a first end of a second material. Additionally, other methods to join the materials 1610 and 1612 may be used such as ultrasonic fusing, lasering, welding, adhesive, heat, wrapping, tying, folding, and/or twisting. As a result, it is contemplated that the intermittent splicer 1614 may terminate a first material at a location along the length of the first material to form a first end and a second end relative to the location of termination. The first end, in this example, is proximate an output region of the intermittent splicer 1614 and the second end is proximate an input region of the intermittent splicer 1614. The first end, in this example, may be joined with a previous second end of a second material (e.g., also proximate the input portion of the intermittent splicer 1614). Further, the second end of the first material may then be joined with a newly created first end (e.g., proximate the output portion of the intermittent splicer 1614) of the second material. As will be discussed hereinafter, it is contemplated that any number of materials in any sequence may be joined.

The intermittent splicer 1614 may also be comprised of one or more maintainers. A maintainer may maintain one or more portions of the materials 1610 and/or 1612 in a desired position during a terminating process and/or during a joining process. For example, it is contemplated that a compression mechanism may hold the first material while terminating the first material. Further, it is contemplated that a maintainer may hold the combined material (e.g., first end of the first material) while being fused with a second end of the second material, even momentarily. However, it is also contemplated that the terminating and/or joining processes may be done on the fly (e.g., as the materials continue to pass through the intermittent splicer 1614).

The intermittent splicer 1614 may also comprise an expelling component (not shown) at the output portion. Once materials 1610 and 1612 have been combined to generate a combined material 1616, the expelling component expels the combined material 1616 from the intermittent splicer 1614. The expelling component may mechanically expel the combined material 1616 using rollers, conveyors, pulleys, and other mechanisms. The expelling component may also/alternatively use, for example, air and/or water to expel the combined material 1616 from the intermittent splicer 1614. Further, it is contemplated that the combined material may be expelled from the intermittent splicer 1614 by gravity and/or a pushing force exerted by an added material portion.

As can be seen from FIG. 16, the combined material 1616 may comprise variable-length segments composed of material A 1610 and material B 1612. For instance, the combined material 1616 may comprise a variable-length segment 1616A composed of material A 1610, a variable-length segment 1616B composed of material B 1612, and a variable-length segment 1616C again composed of material A 1610. Other arrangements are contemplated such as a B-A-B arrangement, an A-B-A-B arrangement, a B-A-B-A arrangement, and so on. When more than two materials are used, the composition of the combined segment 1616 may be adjusted accordingly. By way of illustrative example, if materials A, B, and C are used, one possible composition may comprise A-C-B-A. As can be seen, a near-infinite number of possibilities exist based on the number of materials used, the possible arrangement of materials, and the lengths of each portion of material used.

It is contemplated that the intermittent splicer 1614 may be used in conjunction with any mechanism, such as a loom. Further, it is contemplated that the intermittent splicer 1614 may be used independently of other mechanisms. The intermittent splicer 1614 may also be implemented during any portion of a manufacturing process (e.g., forming the warp, passing the weft).

In an exemplary aspect, once expelled from the intermittent splicer 1614, the combined material 1616 is received by the feeding component 1618 via, for example, an input port. The feeding component 1618 may passively receive the combined material 1616 from the expelling component. The feeding component 1618 may also actively retrieve the combined material 1616 from the intermittent splicer 1614. For instance, the feeding component 1618 may generate a vacuum that draws the combined material 1616 into the feeding component 1618.

The feeding component 1618 is also configured to subsequently feed the combined material 1616 into the loom 1622. The combined material 1616 may be fed in to the loom 1622 as a weft. However, as previously discussed, the combined material may be used in connection with forming a warp beam. If the combined material 1616 is fed in as a weft, the feeding component 1618 may comprise a shuttle, one or more rapiers, an air jet, a water jet, and the like.

The feeding component 1618 may be associated with the dynamic tensioner 1620. The dynamic tensioner 1620 is configured to apply a variable amount of tension to the combined material 1616 as it is being fed into the loom 1622 by the feeding component 1618. The amount of tension applied may depend on the properties of the combined material 1616 as it is passing through the dynamic tensioner 1620. For instance, a smaller degree of tension may be applied to a more elastic segment of the combined material 1616 as compared to the amount of tension applied to a less elastic segment of the combined material 1616. Applying variable amounts of tension depending on the properties of the combined material 1616 helps to ensure that the combined material 1616 is fed smoothly into the loom 1622. Further, it is contemplated that the dynamic tensioner 1620 dynamically adjusts tension based, at least in part, on the characteristics of the combined material 1616 that has already passed through the dynamic tensioner 1620 for a particular weft pass. For example, if a non-elastic portion of material initially passes through the dynamic tensioner 1620, a greater amount of tension may be applied than when an elastic portion or even a subsequent non-elastic portion passes through the dynamic tensioner 1620 on a common weft pass.

The dynamic tensioner 1620 may apply tension by, for example, adjusting the diameter of the input port of the feeding component 1618. In instances where the feeding component 1618 is an air jet, tension may be adjusted by varying the amount of air used to propel the combined material 1616 into the loom 1622. Likewise, if the feeding component 1618 is a water jet, tension may be adjusted by varying the force of the water used to propel the combined material into the loom 1622. Further, it is contemplated that the dynamic tensioner 1620 may be formed from one or more compressive surfaces that apply varied levels of compressive forces on the combined material (e.g., rotating (or not) mated discs in a pulley-like orientation that have graduated mated surfaces that may be separated or closed to impart a desired level of compressive force to a multiple material passing through the graduated mated surfaces).

The dynamic tensioner 1620 may use a caliper-based system to determine when tension should be adjusted and how much the tension should be adjusted. For example, the caliper system may detect a thicker segment of the combined material 1616 and increase the tension applied to the combined material 1616. The dynamic tensioner 1620 may also use a vision/optical system to visually detect a transition from one segment of the combined material 1616 to an adjacent segment of the combined material 1616. The vision/optical system may also detect properties of the segment that determine how much tension should be applied; the tension may then be adjusted accordingly. For instance, the vision/optical system may be configured to detect a color or texture change from one segment to the next of the combined material 1616. Based on this change, the dynamic tensioner 1620 may adjust the tension on the combined material 1616. The dynamic tensioner 1620 may also use a timing system to determine when tension should be adjusted. For example, the combined material 1616 may be expelled from the intermittent splicer 1614 at a constant rate. The dynamic tensioner 1620 may adjust the tension depending on the rate of expulsion. The dynamic tensioner 1620 may also receive inputs from, for example, the logic unit 1624, and adjust the tension based on the received inputs. As a result, it is contemplated that one or more mechanisms may be implemented independently or in concert to adjust the dynamic tensioner 1620 to impart one or more desired characteristics to a resulting product at one or more desired locations.

In one aspect, the dynamic tensioner 1620 may be utilized as a quality control measure. For instance, the dynamic tensioner 1620 may apply an additional amount of tension to the combined material 1616 to adjust the combined material 1616 after it has been fed as a weft through a shed. This may be used to correct minor deviations in alignment of the weft with respect to the pattern that is being woven. For example, if a combined material has a particular portion intended to be placed at a particular location (e.g., at a particular location laterally along the warps), the dynamic tensioner 1620 may impart an elevated level of tension to allow the combined material to slightly extend a length at which it crosses a portion of the warp. Similarly, it is contemplated that the dynamic tensioner 1620 may impart a decreased level of tension to allow the combined material to slightly reduce a length affecting a location as portion crosses a particular warp. Additional mechanisms for adjusting a location of the combined material are contemplated that may not affect the stretch of the combined material (e.g., incorporating an excess portion at either (or both) ends of a weft pass to allow for lateral alignment by the feeding component 1618.

Although the dynamic tensioner 1620 is shown in FIG. 16 as being integrally attached to the feeding component 1618, other arrangements are contemplated. For instance, the dynamic tensioner 1620 may be physically separate from the feeding component 1618. The dynamic tensioner 1620 may be located between the intermittent splicer 1614 and the feeding component 1618. Alternatively, the dynamic tensioner 1620 may be located between the feeding component 1618 and the loom 1622. Further, as previously discussed, it is contemplated that one or more components may be omitted entirely or in part, in an exemplary aspect.

As mentioned, the feeding component 1618 feeds the combined material 1616 into the loom 1622 as either a warp or a weft. The loom 1622 may comprise any type of weaving structure. For example, the loom 1622 may comprise a single or multiple-beam loom, a Jacquard loom, a Dobby loom, and other looms known in the art.

The logic unit 1624 may be programmably-coupled to the intermittent splicer 1614, the feeding component 1618, the dynamic tensioner 1620, and/or the loom 1622 through a wireless or wired connection. The logic unit 1624 may be comprised of a processor and memory to perform one or more of the functions provided herein. Computer-readable media having instructions embodied thereon for performing one or more functions may be implemented with the logic unit 1624 to effectuate one or more of the functions. The logic unit 1624 may instruct these various components based on, for example, a pattern program to produce a woven product conforming to the pattern.

Figure 21:
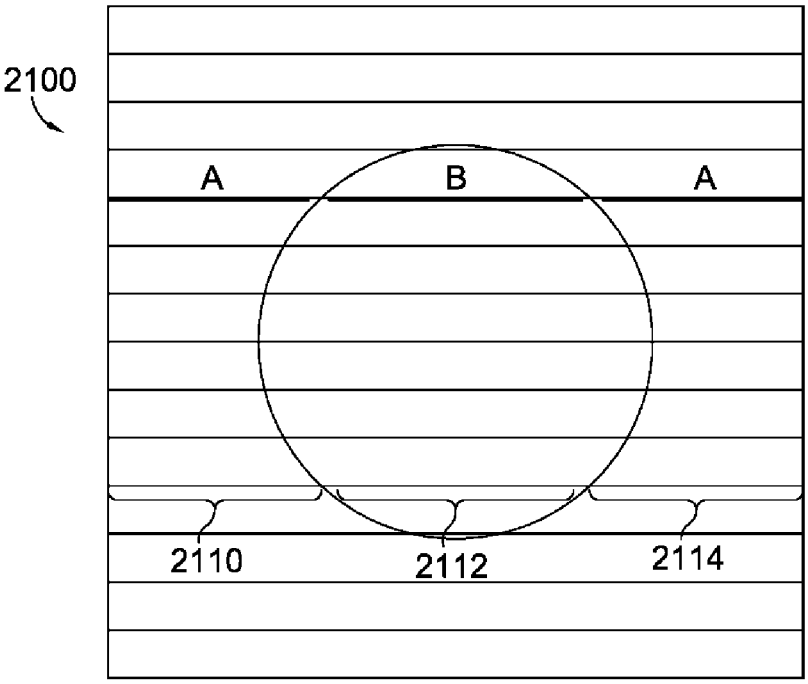
FIG. 21 depicts an exemplary pattern program used by a logic unit in an aspect of the present embodiments.

FIG. 21 depicts an exemplary pattern program 2100 that may be captured (e.g., by a camera) and processed by the logic unit 1624 to calculate what segment lengths of material A 1610 and/or material B 1612 are needed at each weft (and/or warp) level. The pattern program 2100 comprises a series of lines corresponding to wefts with a pattern superimposed on the lines. The lengths of various segments of the pattern program 2100 may be determined by the logic unit 1624 and subsequently communicated to, for example, the intermittent splicer 1614. For example, the logic unit 1624 may determine a length/distance of segment 2110 (corresponding to material A 1610), segment 2112 (corresponding to material B 1612), and segment 2114 (corresponding to material A 1610). The various lengths/distances of these segments 2110, 2112, and 2114 may be communicated by the logic unit 1624 to the intermittent splicer 1614; the intermittent splicer 1614 then terminates and combines materials based on these inputs.

Further, the logic unit 1624 may also be programmably-coupled to the various vision/optical, timing, toggle wheel, and caliper-based systems associated with these components. The logic unit 1624 may, in one aspect, receive inputs from the various vision/optical, timing, toggle wheel, and caliper-based systems, and, based on these inputs and a programmed pattern/structure, instruct the intermittent splicer 1614 to terminate the material A 1610 or the material B 1612 at a predetermined location. Further, the logic unit 1624 may instruct the dynamic tensioner 1620 to apply a predetermined amount of tension to the combined material 1616 based on received inputs.

As provided herein, it is contemplated that the logic unit 1624 may be comprised of a computing device. Therefore, the logic unit 1624 may maintain one or more set of instructions useable by one or more components (e.g., intermittent splicer, loom, dynamic tensioner, Jacquard loom, measurement components, quality control components) to manufacture an article. The instructions may include logic capable of coordinating the automatic terminating and splicing of materials such that when inserted through a shed may be positioned in a defined location relative to the warp beam. Further, the logic may ensure the proper alignment and positioning of one or more portions of a multiple material element as integrated into an article.

The logic unit 1624 may store the instructions or may receive the instructions. For example, it is contemplated that the logic unit 1624 may be connected via a network to one or more computing devices that maintain parameters to complete a particular article. Upon receiving an indication to manufacture a particular article, the proper instructions (or portions thereof) are communicated to the logic unit 1624 for controlling one or more components to effectuate the manufacturing of the article. As such, it is contemplated that the logic unit 1624 may be responsible for ensuring that typically disparate components may operate in concert to automatically produce an article through the coordination of one or more functions of each of the components.

Figure 17:
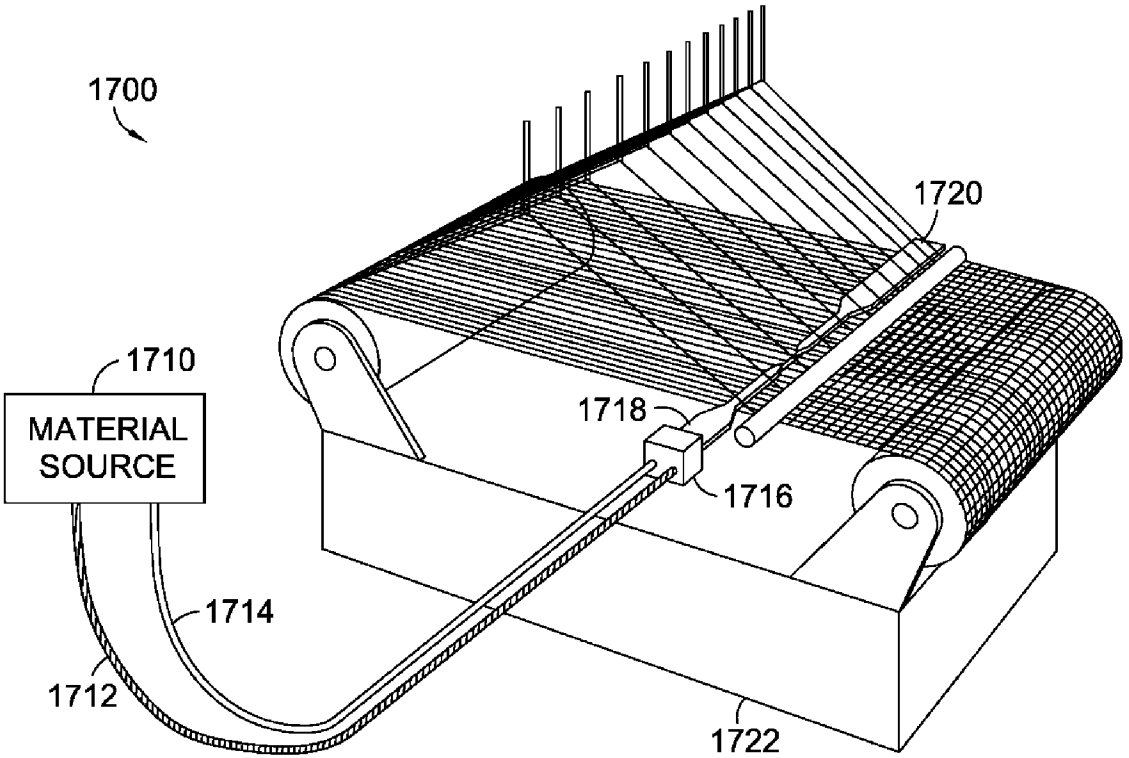
FIG. 17 depicts an exemplary intermittent weaving splicer in association with a feeding component in an aspect of the present embodiments.

Turning now to FIG. 17, another aspect of the present embodiments is illustrated. FIG. 17 depicts a system 1700 comprising a material source 1710, a material 1712, a material 1714, an intermittent splicer 1716 that is integrally connected to a feeding component 1718, and a receiving component 1720. The feeding component 1718 and the receiving component 1720 may comprise a first rapier and a second rapier. Traditional weaving technology employs rapiers to feed wefts across a shed. A first rapier feeding a weft is met by a second rapier at a point across the width of the weave. The second rapier takes the weft and completes the journey of the weft across the width of the weave (e.g., the length of the warp beam).

The feeding component 1718 may be dynamically programmed (by, for example, a logic unit) to deliver the weft to the receiving component 1720 at varying distances along the width of the weave instead of at the midway point of the weave. Further, the intermittent splicer 1716 may be programmed to terminate material 1712 and/or material 1714 and generate a combined material prior to the feeding component 1718 meeting the receiving component 1720 and transferring the combined material.

Figure 18:
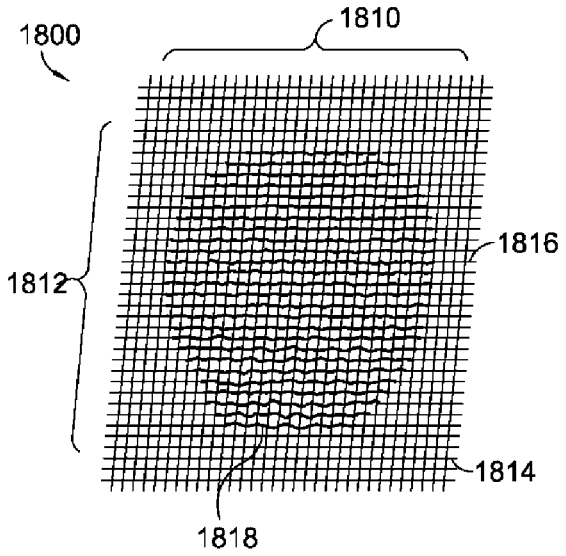
FIG. 18 depicts an exemplary portion of a woven product in an aspect of the present embodiments.

FIG. 18 depicts a close-up view of an exemplary woven product 1800 that may be produced by the system 1600. The woven product 1800 comprises a series of warp threads 1810. Although the term "thread" is used for convenience sake, it is contemplated that the term "thread" may comprise any type of material discussed previously, including fabric materials, plastic materials, synthetic materials, metal materials, and the like. The woven product 1800 also comprises a series of weft threads 1812. In this example, a portion of the weft threads 1812 comprises combined material weft threads generated by, for example, an intermittent splicer such as the intermittent splicer 1614 of FIG. 16. Thread 1814 provides an example of a weft thread that is comprised of one material, while thread 1816 illustrates a weft thread comprised of more than one material.

The weft threads 1812 are woven to produce an area 1818. The area 1818 may have different functional properties as compared to the remainder of the woven product 1800. For instance, the area 1818 may have a greater amount of stretch as compared to the remainder of the woven product 1800. In another example, the area 1818 may be composed of thermoreactive, and/or chemical reactive materials (e.g., water soluble). These materials may be treated with an appropriate agent (heat, water, and/or chemical) to eliminate the area 1818 or to further change the functional properties of the area 1818.

Additionally, the area 1818 may have different aesthetic properties as compared to the remainder of the woven product 1800. For instance, the area 1818 may be a different color than the remainder of the woven product 1800, or be composed of weft threads having a matte or shiny finish. The area 1818 may comprise a logo, graphic elements, geometric-shaped patterns, or organically-shaped patterns. Further, the area 1818 may be woven from weft threads having a different diameter as compared to the remainder of the woven product 1800. This may help to impart a three-dimensional aspect to the area 1818.

Figure 20:
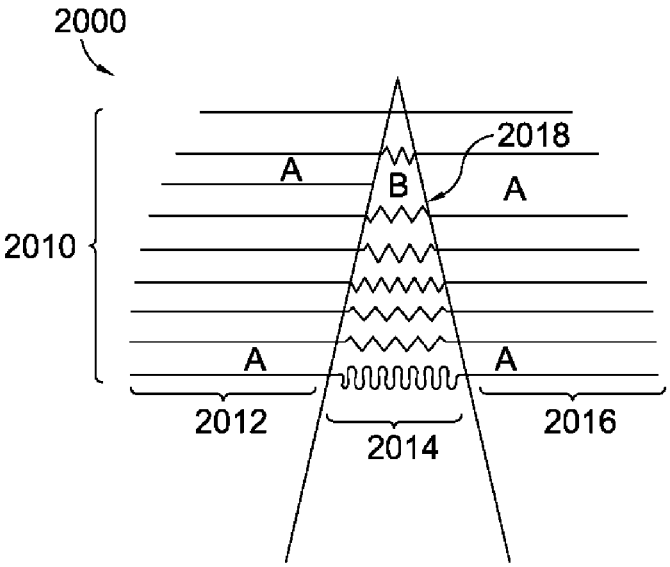
FIG. 20 depicts an exemplary portion of a woven product in an aspect of the present embodiments.

FIG. 20 depicts another exemplary portion of a product 2000 that may be produced by the system 1600. The focus of FIG. 20 is on the combined material that makes up the weft threads 2010. Because of this, the warp threads are not depicted. The combined material that makes up the weft threads 2010 comprises a first segment 2012 of a first material (material A), a second segment 2014 of a second material (material B), and a third segment 2016 of the first material (material A). The second material in the second segment 2014 may comprise crimped yarn. Examples of crimped yarn include polyester fill used for insulation in jackets or as stuffing in pillows. This type of yarn is generally resistant to stretching which gives it loft and volume. However, crimped yarn typically stretches as heat is applied; the heat causing the crimped yarn to lose its crimp. Taking advantage of these properties of crimped yarn, heat may be selectively applied to the portion of the product 2000 containing the crimped yarn (i.e., area 2018). The application of heat may cause the area 2018 to elongate or stretch which adds three-dimensionality to the product 2000. One example where this type of process is useful is in the creation of a heel portion of a shoe upper.

Figure 19:
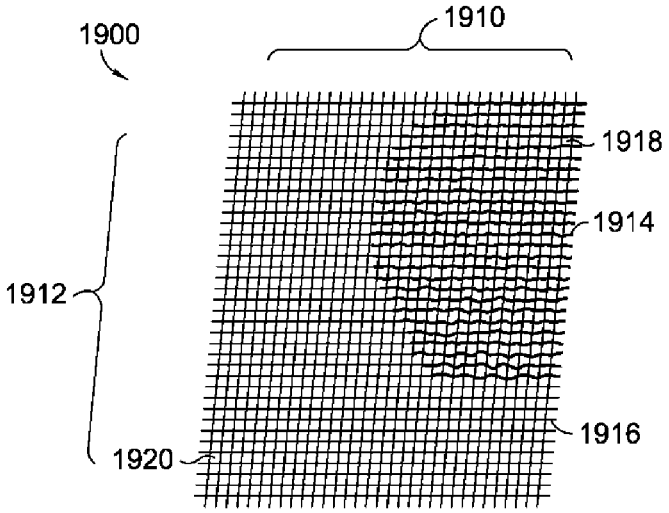
FIG. 19 depicts an exemplary portion of a woven product in an aspect of the present embodiments.

FIG. 19 depicts an exemplary portion of a woven product 1900 that may be produced by the system 1700. The woven product comprises a set of warp threads 1910 and a set of weft threads 1912. Like above, the term "thread" is meant to encompass any number of materials. A portion of the weft threads 1912 comprises weft threads of combined materials generated by an intermittent splicer such as the intermittent splicer 1716 of FIG. 17. Weft thread 1914 is an example of a weft thread of combined materials. Additionally, a portion of the weft threads 1912 comprises weft threads composed of one type of material (for example, weft thread 1916).

As described above, the system 1700 comprises a feeding component (in this case, a first rapier) that may be dynamically adjusted to deliver weft threads different distances along the width of the weave. A corresponding receiving component (a second rapier) may also be dynamically adjusted to receive the weft thread at the point of handoff from the feeding component. An intermittent splicer may generate a weft of combined materials prior to the receiving component receiving the weft thread from the feeding component. The result is the ability to produce a variety of geometric or organically-shaped patterns having different functional and/or aesthetic properties. For instance, area 1918 of the woven product 1900 is composed of weft threads having different properties from the weft threads that make up the area 1920. Like above with respect to FIGS. 18 and 20, the weft threads in the areas 1918 and 1920 may have different functional properties and/or different aesthetic properties.

As depicted, it is contemplated that any combination of combined materials may be implemented at any location to form a product having organic-shaped characteristic portions imparted by selectively changing underlying materials of a weft. For example, the characteristic portions may have varied aesthetic and/or functional characteristics at specified locations. The ability to selectively impart desired characteristics intermittently in a weft pass (as opposed to having a uniform characteristic along a complete weft pass) provides increased control of a weaving process.

Figure 22:
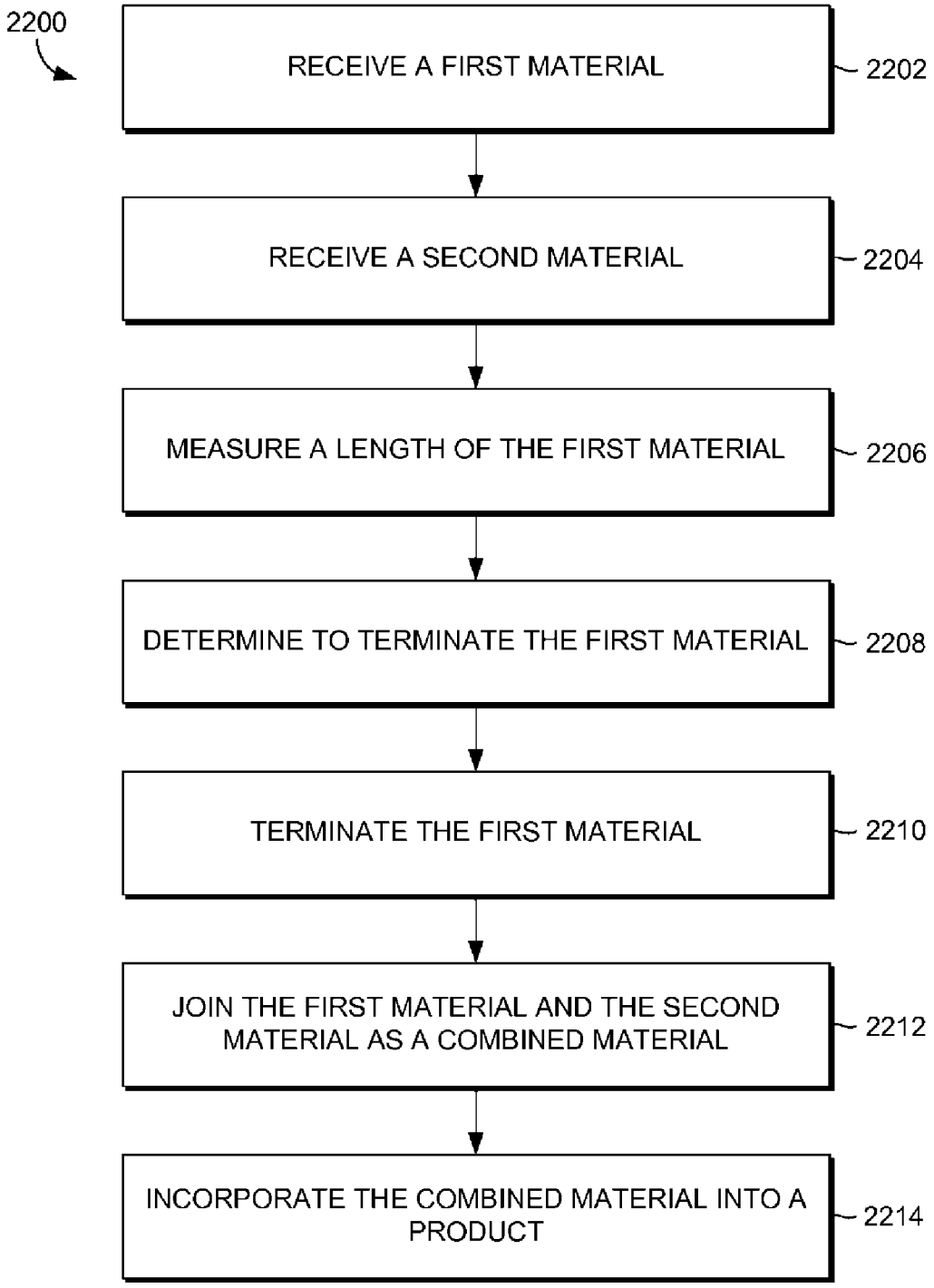
FIG. 22 depicts an exemplary flow diagram illustrating a method of creating a combined material from a first material input and a second material input in an aspect of the present embodiments.

FIG. 22 depicts a block diagram illustrating an exemplary method 2200 for utilizing an intermittent splicer, in accordance with aspects of the present embodiments. At a block 2202, a first material is received at the intermittent splicer. As previously discussed, the material may be any material, such as a yarn, thread, webbing, and the like. Receiving of a material may include a portion of the material entering one or more portions of the intermittent splicer. At a block 2204, a second material is received at the intermittent splicer. As previously discussed, any number of materials may be received/utilized at/by an intermittent splicer.

At a block 2206 a length of the first material is measured. The length may be measured to result in a particular length of the first material at a particular location within a resulting combined material. The measuring may be accomplished using mechanical mechanisms, timing mechanisms, optical mechanisms, and other techniques for measuring a length of a material. At a block 2208, a determination is made to terminate the first. The determination may be accomplished utilizing a logic unit that controls a terminator of the intermittent splicer. The determination may be made, at least in part, based on the measured length of the first material and a desired length to be used in a resulting combined material. Further, the logic unit may rely on a programmed pattern that coordinates the intermittent splicer and one or more manufacturing machines (e.g., loom, knitting machine, braider), which may be used in conjunction with the intermittent splicer. Once a determination to terminate is made at the block 2208, at a block 2210 the first material is terminated. The termination may be effected by a mechanical cutting, a chemical process, a heating process, an ultrasonic process, and/or the like.

At a block 2212, the first material and the second material are joined. The joining of the first and second materials may rely on a mechanical connection among elements (e.g., fibers) of each of the materials. Additionally, it is contemplated that other bonding techniques may be used to join the first material and the second material (e.g., welding, adhesive). Once the first material and the second material are joined, the resulting combined material may be incorporated into a product at a block 2214. For example, the resulting product may be formed using a number of machines and techniques, such as a loom for a woven article, a knitting machine for a knit article, a braiding machine for a braided article, and the like.

As previously discussed, a Jacquard-type machine may be implemented to raise and lower the appropriate warps at the appropriate time to form the first and the second layer. Other techniques are contemplated for forming the multi-layered woven article.

Multi-Layered Woven Element

Figure 23:
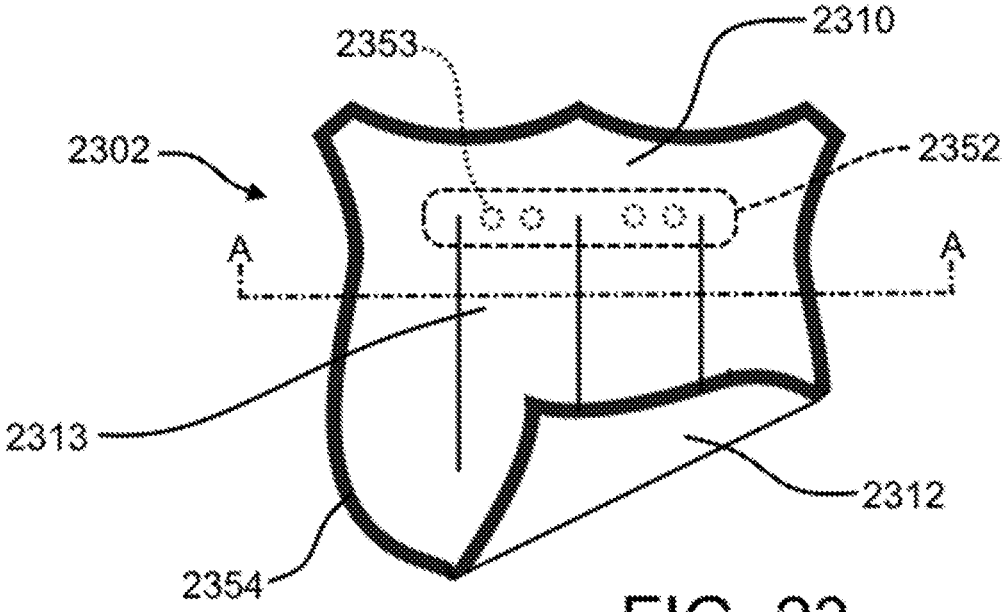
FIG. 23 depicts a woven element comprising a graphic image on a first surface.

FIG. 23 illustrates one embodiment of a multi-layered woven element 2302. The term "woven element" is used for convenience, though it is contemplated that a multi-layer non-woven textile could be used. Referring to FIG. 23, the woven element 2302 may have a structure with a front surface 2310 and a back surface 2312 facing opposite the front surface. The front surface 2310 may include a woven graphic image 2313 including a team or company logo, a picture, an ornamental design, one or more solid-color or multi-color regions, a solid-color or multi-color region incorporated into a cutout, a solid-color or multi-color region incorporating a cutout, or the like. The back surface 2312 may have characteristics differing from the characteristics of the front surface 2310, and particularly may have a generally smooth, uniform structure suitable for direct contact with and/or bonding to a base element.

Figure 24A:
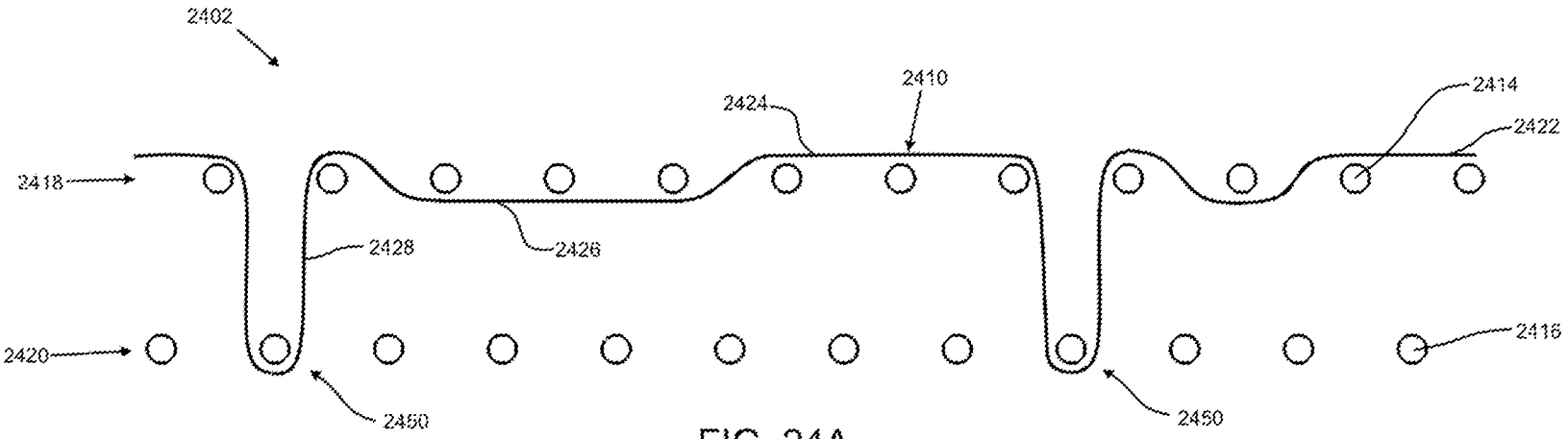
FIG. 24A depicts a cross-sectional diagram view of an embodiment of a multi-layered woven element.

The woven element 2302 may have a tubular structure (e.g., a multi-layer or multi-panel structure) formed by positioning (e.g., "dropping") some warp threads to one side of the fabric to form a second layer, as shown by woven element 2402 in FIG. 24A. FIG. 24A depicts an exaggerated cross-sectional portion of the woven element 2302 through line A-A of FIG. 23. For simplicity, the woven element 2402 is described as a multi-layered woven element with two layers, though it is contemplated that the woven element 2402 could have three or more layers. FIG. 24A is exaggerated to clearly show the layers, but the layers may be integral and/or tightly bound together such that separate layers are not readily distinguishable.

Turning to FIG. 24A, the woven element 2402 has a plurality or set of warp threads depicted as the first warp threads 2414 extending in a first direction corresponding to the warp direction of the weave. The first warp threads 2414 may be substantially parallel. The first warp threads 2414 may be associated with a first panel or layer 2418 at the depicted cross-section A-A (of FIG. 23). It is contemplated that in some locations (e.g., other cross-sections), one or more of the first warp threads 2414 may be integrated or interwoven into another layer. Similarly, a plurality or set of second warp threads 2416 may be dropped to the back side of the fabric to form the depicted second panel or layer 2420. The first layer 2418 is depicted with a front surface 2410, and the second layer 2420 is depicted with a back surface 2412 (shown in FIG. 24B).

A first weft thread 2422 may generally extend in a second direction corresponding to the weft direction of the weave, where the second direction is substantially perpendicular to the first direction (where the first direction corresponds to the warp direction). The first weft thread 2422 is depicted with a first portion 2424 positioned in front of at least one of the first warp threads 2414 (and in the depicted embodiment, in front of three consecutive first warp threads 2414). Accordingly, the first portion 2424 of the first weft thread 2422 may be visible on the front surface 2410 to contribute to a woven graphic image (e.g., graphic image 2313 of FIG. 23). In some embodiments, the first weft thread 2422 may have a particular color or other visual property, and may be selectively placed as visible on the front surface 2410 where the associated color or visual property is called by the graphic image. The first portion 2424 of the first weft thread 2422 may extend continuously in front of any number of first warp threads 2414 (e.g., two, five, ten, twenty, or even fifty or more consecutive first warp threads 2414 depending on what is called for by the graphic image, the type of finish, the desired durability, the desired surface characteristics, and the like).

Multiple weft threads may be inserted together in single weft insertion step such that these multiple weft threads follow the same path in the weft or form the same pick. This feature may increase the color coverage at selected areas of a graphic image and may provide textural and/or three-dimensional effects where multiple weft threads are placed on the front surface 2410 together. This feature may be accomplished by using any suitable multi-channeling technique, including (but not limited to) a double or triple channeling technique where more than one weft thread is inserted into the shed (i.e., the temporary separation between the warp threads during the weaving process) during the same weft-insertion step. Further, multiple weft threads may be intertwined or wrapped together prior to their insertion into the shed.

In some embodiments, the denier of the weft threads associated with the graphic image may be optimized for providing crisp, fine-resolution graphic detail. To achieve a high resolution in a region of a graphic, a relatively fine thread may be used in the weft. Thicker weft threads may include in regions of lower resolution or solid color. In one example, the denier of the weft threads associated with the graphic image may be approximately 50 denier with some threads potentially being 75 denier in regions of relatively low resolution or solid color. In some embodiments, even smaller deniers are used (e.g., 30 denier or smaller). The current embodiments are not limited to any specific denier for either the warp or weft threads, and multiple deniers may be used in a single woven element.

To achieve a high quality image, it may be desirable to achieve a relatively high thread density to thereby achieve a high number of image pixels. For example, when a loom is used, the end count (measured in warp ends per inch of fabric) may be maximized by utilizing the full capacity of warp ends available on the loom. The pick count (measured in weft threads per inch of fabric) may then be maximized by using the highest pick count possible without causing significant manufacturing complications due to the limitations of the weaving device. In exemplary embodiments, a 288 Satin Broadloom, or another suitable weaving device allowing for a relatively high thread density, may be used. In one non-limiting example (and as noted above), the end count of a multi-layered woven element is approximately 288 warp threads per inch, while the pick count is approximately 5000 weft threads per inch. It is contemplated that the density of the threads, both warp and weft, may vary at different locations within a single woven element and/or may vary between the layers of the multi-layered woven element.

When weaving a graphic image, the figure-forming threads (e.g., the weft threads exposed to the front surface of a woven element to form a graphic image) often have floating portions that are positioned behind the warp threads to be hidden from view in certain regions. Accordingly, the first weft thread 2422 may comprise a floating portion (e.g., a second portion 2426) that is positioned behind one or more of the first warp threads 2414. As shown, the second portion 2426 of the first weft thread 2422 extends between the first warp threads 2414 and the second warp threads 2416 such that an observer viewing the front surface 2410 would not readily see the second portion 2426. The second portion 2426 of the first weft thread 2422 may be selectively placed between the first warp threads 2414 and the second warp threads 2416 when the graphic image does not call for the visual effect associated with that thread. The first weft thread 2422 can extend any distance between the first warp threads 2414 and the second warp threads 2416. It is contemplated that the second portion 2426 of the first weft thread 2422 may extend continuously between the first warp threads 2414 and the second warp threads 2416 for a length extending across three consecutive first warp threads 2414, and in some instances may extend continuously for a much greater length (e.g., a length across ten, twenty, fifty, or even one hundred or more consecutive first warp threads 2414 as called for by the graphic image and other desired characteristics of the woven element).

The first weft thread 2422 may further have a third portion 2428 positioned behind at least one of the second warp threads 2416. This may provide a binding effect between the first layer 2418 and the second layer 2420. In other words, the third portion 2428 of the first weft thread 2422 may act as a tie-like structure (depicted as tie structure 2450) to maintain an aligned and integral relationship between the layers 2418 and 2420. In some embodiments, a separate weft thread may be included that primarily serves the purpose of binding the layers 2418 and 2420 together by alternating between the first and second warp threads 2414 and 2416.

Figure 24B:
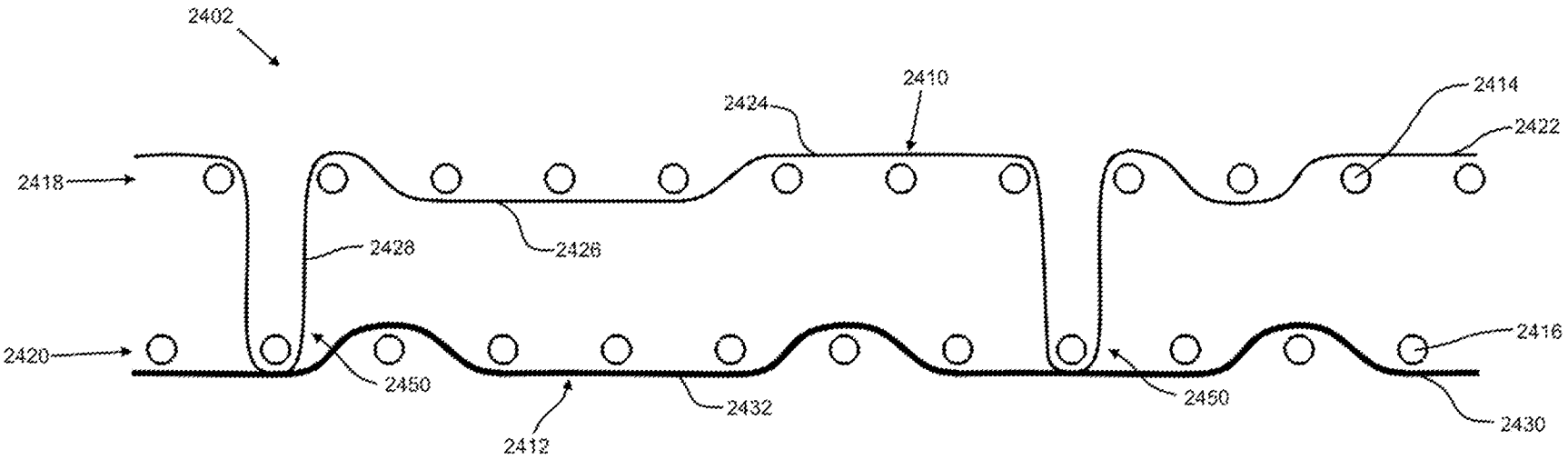
FIG. 24B depicts a cross-sectional diagram view of a second embodiment of a multi-layered woven element.

As shown in FIG. 24B, a second weft thread 2430 may primarily be associated with the second layer 2420, though it may also be interwoven with the first warp threads 2414 at selected or substantially random locations to provide a binding effect between the layers 2418 and 2420. The second weft thread 2430 is depicted as located within the same cross-section (i.e., the same plane perpendicular to the front and back surfaces of the woven element 2402) as the first weft thread 2422. While it is contemplated that the at least a portion of the second weft thread 2430 and the first weft thread 2422 could be located in the same cross-section, they could alternatively be positioned in different cross-sections of the woven element 2402. The first and second weft threads 2422 and 2430, which follow different paths in the weft, may be inserted into the weave during separate weft-insertion steps. The second weft thread 2430 may provide functional characteristics to the woven element 2402 and may or may not contribute to the visual properties of the graphic image on the front surface 2410. As such, and particularly when the primary purpose of the second weft thread 2430 is functional, its characteristics may substantially differ from the characteristics of the first weft thread 2422. Accordingly, in some embodiments, the second weft thread 2430 may have desirable mechanical properties, such as a certain stretchability, strength, electrical or thermal conductivity, magnetism, permeability, melting point, density, degree of crimp, etc. The first and second threads 2422 and 2430 may also have varying visual properties (e.g., color, texture, luminance, etc.), contact properties (texture, softness, etc.), and/or size properties (denier, etc.) that contribute to the functional and/or structural characteristics of the woven element 2402.

To illustrate, it is contemplated that the second weft thread 2430 may have a larger denier than the denier of the first weft thread 2422 to provide the woven element 2402 with suitable strength, rigidity, and the like, while the first weft thread 2422 provides a fine-resolution graphic image. Any suitable type of thread may be used in either the warp or the weft to achieve a variety of functional properties and/or visual effects. Types of threads that can be used include, but are not limited to, polyester threads (semi dull, full dull, Trilobal, etc.), rayon threads, nylon threads, heathered threads, space dyed threads, metallic threads (e.g., as manufactured by Lurex), monofilament threads, reflective threads, and burnout threads (i.e., dévore threads). In some embodiments, one or more threads may be made of or include a metal (e.g., gold, silver, copper, etc.) and may be configured to conduct electricity and/or heat.

Further, it contemplated that some or all of the threads in the warp or weft of the woven element 2402 could have properties that change in response to a stimulus (e.g., temperature, moisture, sweat, electrical current, magnetic field, light, etc.). In one example, and as described in detail below, the second weft thread 2430 may be made of a thermoreactive material responsive to heat. A thermoreactive material may be, for example, a thermopolymer or thermoplastic polymer that transitions from a solid state to a softened or liquid state when subjected to certain temperatures. Specific materials may include, but are not limited to, polyurethanes, polyesters, polyamides, polyolefins, and nylons. In some embodiments, the second weft thread 2430 may have a coating of a thermoreactive material and a core that is not formed of a thermoreactive material.

In another example, one or more threads may be used that change dimensionally with the presence of water. For example, at least a portion of the filaments or fibers in the threads may be formed of a moisture-absorptive polyester material, such as the various moisture-absorptive polyester materials manufactured by Teijin Fibers Limited of Japan. In some configurations, the threads may be entirely formed from moisture-absorptive materials. In other configurations, the threads may be formed from combinations of both moisture-absorptive materials and non-moisture-absorptive materials. For example, the threads may be formed from 50 percent moisture-absorptive polyester materials and 50 percent non-moisture-absorptive polyester materials. As a more specific example, the threads may be a semi-dull cationic polyester 50 percent and nylon 50 percent side-by-side conjugate thread with a 75 denier, 24 filament structure. Other relatively non-moisture-absorptive polymer fibers or filaments may also be utilized, such as rayon, nylon, and polyacrylic.

A substantial portion of the second weft thread 2430, depicted as backing portion 2432, may be positioned or dropped behind the second warp threads 2416. Advantageously, this may provide control over the surface characteristics of the back surface 2412 of the woven element 2402. In practice, many weft threads with different properties may be dropped behind the second warp threads 2416 to optimize the characteristics of the back surface 2412 for a wide variety of functions.

The tubular structure comprising two layers 2418 and 2420 may have a plurality of tie structures 2450. The tie structures may be placed at random or selected locations throughout the woven element 2402 to provide a uniform bond between layers. It is contemplated that the tie structures may be positioned only along a perimeter of the woven element (allowing for a pocket-like volume to be formed between the layers). In some embodiments, and referring back to FIG. 23, the woven element 2302 may have selected areas where the layers are either not secured or are relatively loosely secured to thereby form a cavity or pocket 2352. The pocket 2352 may be filled with a filler material, such as foam, down, air, or another suitable material or object. This may provide three-dimensional visual effects on the front surface 2310 of the woven element 2302, and/or may provide functional characteristics (e.g., cushioning). In some embodiments, the pocket 2352 may be configured to house at least a portion of an electronic device, such as a temperature sensor, a heart-rate sensor, an electronic controller, or the like. In embodiments having an electronic device within the pocket 2352 or otherwise attached to the woven element 2302, one or more conductive threads of the woven element 2302 may provide an electrical connection to the electronic device and/or may be used to transfer signals between the electronic device and other components. In some embodiments, one layer (e.g., the front or back layer best depicted by FIGS. 24A-C) may be cut away at the boundary of the pocket 2352 leaving only a single layer behind. This may, for example, increase the breathability and decrease the weight of the woven element 2302, may provide desirable visual or functional characteristics on either the front surface 2310 or the back surface 2312, and/or may form an opening to allow a user to insert and remove an object.

When a pocket 2352 is formed, the depicted apertures 2353 may be selectively cut away from one or more layers surrounding the pocket 2352. Alternatively, the apertures 2353 may be integrally formed into a layer of the woven element 2302 during the weaving process by using the techniques described above. In one embodiment, the apertures 2353 may be formed on both the front surface 2310 and the back surface 2312 of the woven element 2302. These apertures 2353 on opposite surfaces may be offset such that there is no direct channel or path through the entirety of the woven element 2302. The apertures 2353 may be included for their visual properties (e.g., a viewer may see the contrast between the layers when apertures are located on the front surface 2310) and/or their functional properties (e.g., they may act as perforations to add breathability to the fabric). The apertures may have any shape. In woven elements with more than two layers, it is contemplated that one or more apertures may be located on any of the layers, a subset of the layers, or all of the layers.

The woven element may have at least one thread formed of a reactive material, such as a water soluble material, an etchable material, a thermoreactive material, a moldable material, or any material that changes in response to temperature, moisture, sweat, electrical current, light, or other stimuli. In one example, referring to FIG. 24B, the woven element 2402 may have threads that are fusible or non-fusible. A non-fusible thread may be substantially formed from a thermoset polyester material and a fusible thread may be at least partially formed from a thermoreactive material such as thermoplastic polyester. Optionally, the thermoreactive thread may have a sheath comprising a thermopolymer or other fusible coating and a non-fusible core. The thermoreactive thread may be activated (e.g., at least partially melted) with the application of heat, and then allowed to cool to form a film. When the thermoreactive thread is fused to non-fusible threads, it may have the effect of stiffening or rigidifying the structure of woven element 2402. Moreover, using thermoreactive threads may have the effect of securing or locking the relative positions of the threads (both thermoreactive and non-thermoreactive) within woven element 2402. Another feature of using thermoreactive threads in portions of the woven element 2402 relates to limiting unraveling if a portion of the woven element 2402 becomes damaged or severed. Thermoreactive threads may also be selectively placed near portions that will be cut out (e.g., apertures) to provide a seal at the cut by reacting to the heat provided by the cutting device. Further, the thermoreactive threads may be used to fuse or bond the woven element 2402 to other structures, such as textile base element. Optionally, thermoreactive threads with different melting temperatures may be provided. Using thermoreactive threads with different melting temperatures may be advantageous where thermoreactive threads are used for multiple functions. For example, thermoreactive threads with a relatively high melting point may be used to bond the woven element 2402 to a base element. Different thermoreactive threads with a lower melting point may be later activated (and potentially re-activated after bonding) to add textural characteristics to the front surface 2410 during a separate post-processing step. In this example, the textural characteristics may be formed at a temperature lower than the melting point of the thermoreactive threads used for bonding, and therefore the textural characteristics may be formed without compromising the bond between the woven element 2402 and the base element.

The second weft thread 2430 of FIG. 24B may be at least partially formed of a thermoreactive material with a melting point lower than other threads within the woven element 2402. The thermoreactive material may be activated through the application of heat any time after the weaving process. The application of heat may cause the second weft thread 2430 to melt and/or fuse to the second warp threads 2416 and/or other threads in the woven element 2402 to reinforce or lock the woven structure. Alternatively, or in addition, the thermoreactive material may serve to fuse or bond the woven element 2402 to another object, including a base element as described below. It is also contemplated that certain reactive threads may be included for their visual effects. For example, certain threads may be activated to achieve particular visual effects on the front surface 2410 of the woven element 2402 (e.g., a weft thread may be partially or substantially melted and cooled to appear as a smooth finish in a desired area).

In one application, the backing portion 2432 of the second weft thread 2430, which forms at least a portion of the back surface 2412, may be at least partially formed of a reactive material, such as a thermoreactive material. The backing portion 2432 may be exposed on the back surface 2412 of the woven element 2402, giving the back surface 2412 the ability to fuse or bond to another object when heated. It is contemplated that the exposed backing portion 2432 will form a substantial percentage of the second weft thread 2430. In some embodiments, the backing portion 2432 of the second weft thread 2430 may form anywhere from about 5% to about 99%, and often more than 50%, of the length of the second weft thread 2430 extending across the woven element 2402 (i.e., the width in the weft direction). In a more specific example, the backing portion 2432 may form about 80% of the length of the second weft thread 2430 extending across the woven element 2402. This percentage, along with the denier of the thread and the location in the woven element 2402, may be selected to optimize the characteristics of the back surface 2412 and may vary between different weft threads at different locations of the woven element 22402.

Figure 24C:
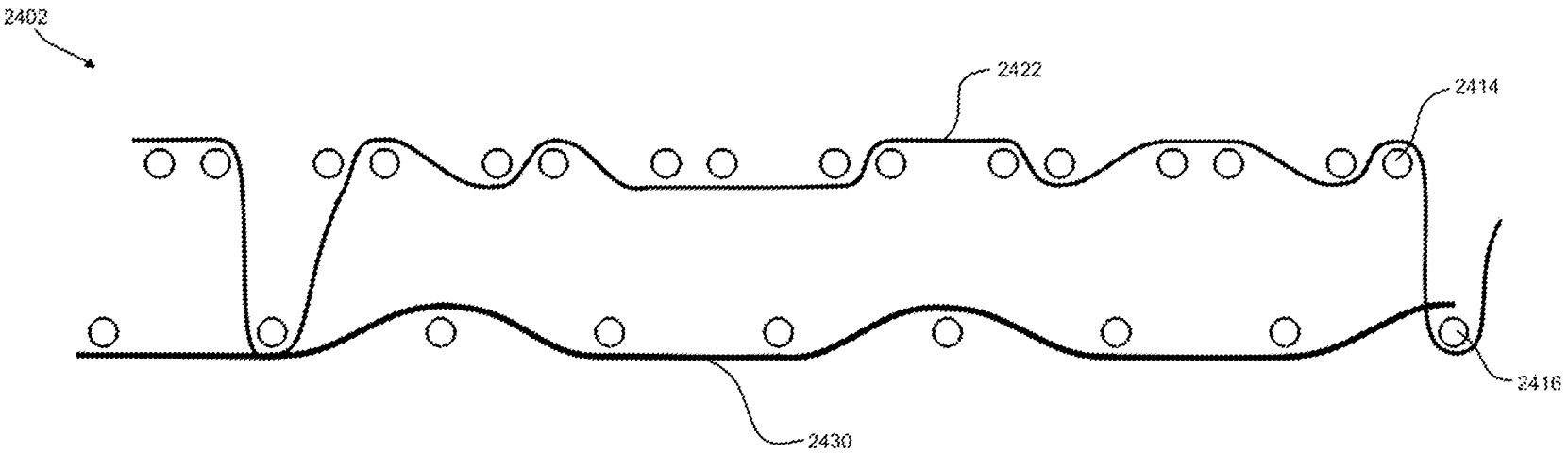
FIG. 24C depicts a cross-sectional diagram view of a third embodiment of a multi-layered woven element.

Referring to FIG. 24C, the woven element 2402 may have substantially more first warp threads 2414 associated with the first layer 2418 than second warp threads 2416 associated with the second layer 2420. As shown, there are about twice as many of the first warp threads 2414 as there are of the second warp threads 2416. This may be advantageous when it is desired to provide a high-quality image on the front surface 2410 by providing a large number of potential positions for image-forming weft threads such as first weft thread 2422. As a result, a higher resolution may be achieved. Anywhere from about 5% to about 95% of the total number of warp threads may be associated with one of the layers at a particular location in the woven element 2402. In exemplary embodiments, approximately 30% of the warp threads may be dropped to the back of the woven element 2402 at any given location to thereby be associated with the second layer 2420, while approximately 70% are associated with the first layer 2418.

The number of warp threads dropped to the back of the fabric may vary at different locations within a woven element. For example, a woven element may have one or more areas with a high resolution image and other areas where high-resolution is not needed. Here, the percentage of warp threads dropped to the back may be lower in the areas where high-resolution is desired and higher in the other areas. To illustrate, referring back to FIG. 23, the border portion 2354 may comprise a tubular structure with more warp threads dropped to the back as compared to the portion comprising the graphic image 2313. Advantageously, the additional warp on the back side of the woven element 2302 at the border portion 2354 may provide structural integrity near the potentially-vulnerable outer boundary of the woven element 2302, while the additional warp on the front surface 2310 at graphic image 2313 may contribute to achieve a high resolution.

Figure 25:
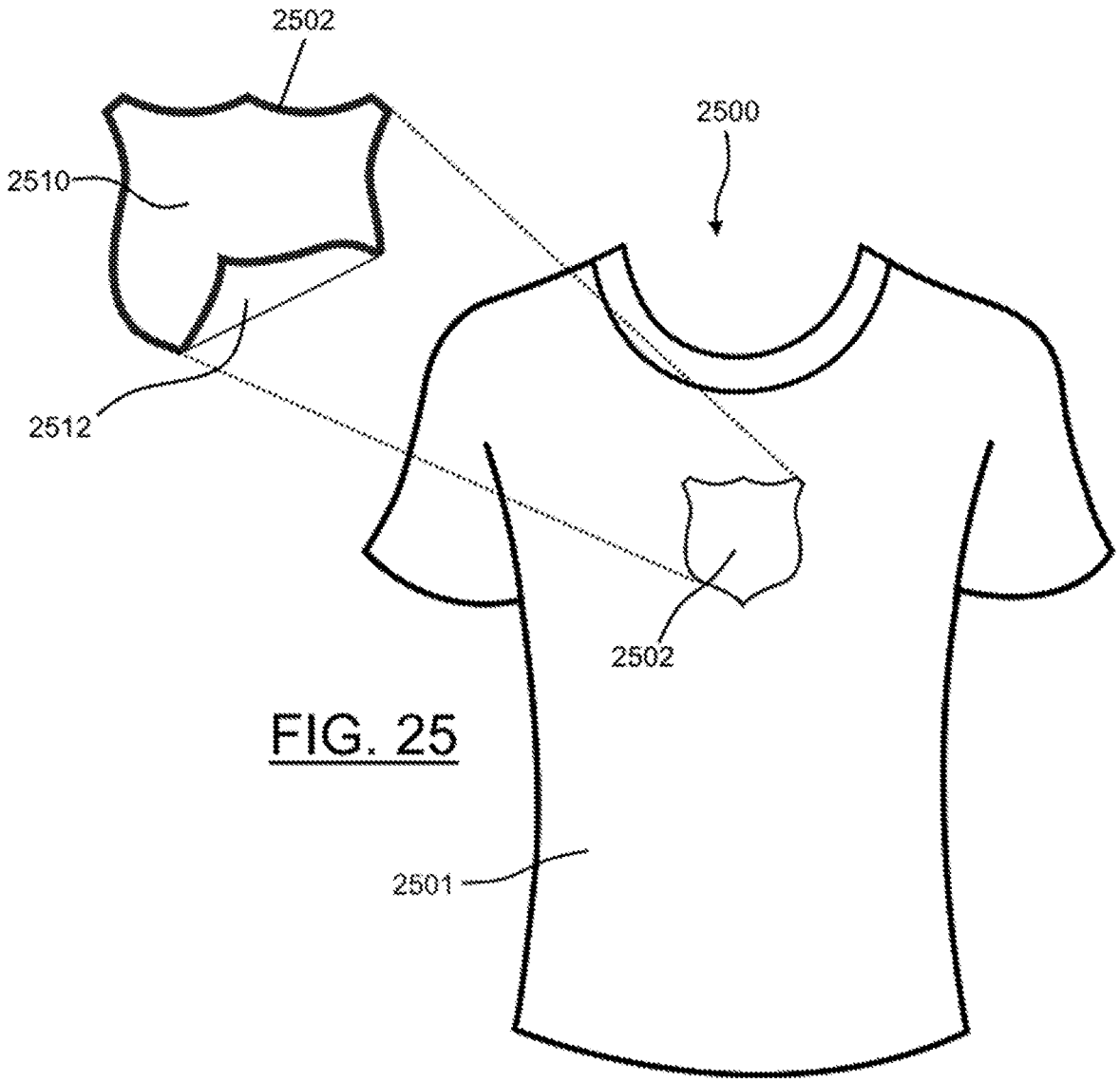
FIG. 25 depicts an article comprising a woven element and a base element.

As depicted in FIG. 25, an article 2500 (depicted as a shirt) may have a base element 2501 and the woven element 2502, where the woven element 2502 has a graphic image on its front surface 2510 in accordance with the embodiments described herein. The base element 2501 may have a textile structure. The woven element 2502 may be secured to the base element 2501 in any one of a variety of ways. In one embodiment, thermoreactive threads exposed on the back surface of woven element 2502 may be heated to fuse or bond the woven element 2502 to the base element 2501. To illustrate, when the backing portion 2432 of the reactive second weft thread 2430 (referring to FIG. 24B) is formed of a thermoreactive material, the thermoreactive material may at least partially fuse to the base element 2501 of FIG. 25 when heat is applied. This embodiment is advantageous for the manufacturing efficiency and simplicity it provides because the bonding mechanism is provided within the woven structure and does not need to be added in a post-weaving step.

Alternatively or in addition, an adhesive may be used to bond the woven element 2502 to the base element 2501. When an adhesive used, the surface characteristics of the back surface 2512 of the woven element 2502 may be optimized for suitable interaction with the adhesive. The adhesive may be applied with or without heat to the back surface 2512 and/or to the base element 2501. It may be desirable to print the adhesive to the back surface 2512 in a particular pattern without covering the entirety of the back surface 2512, as covering the entirety of the back surface 2512 may compromise certain characteristics (such as flexibility or breathability) of the woven element 2502. After the application of the adhesive, the back surface 2510 may be placed in direct contact with the base element 2501 to allow the adhesive to set.

In some embodiments, it may be preferable to use an adhesive that does not require heat during application. For example, in some configurations, a thermoreactive material is included in the woven element 2502 which may be activated at some point during the manufacturing process (either before or after bonding to the base element 2501) to produce a visual or functional effect separate from bonding the woven element 2502 to the base element 2501. In these configurations, the application of heat during a bonding step may inadvertently activate the thermoreactive material causing complications or compromising certain characteristics of the woven element 2502. It is also contemplated that the thermoreactive threads used for bonding may have a different melting point than other thermoreactive threads of the woven element 2502.

The back surface 2512 of the woven element 2502 may be configured to have a generally smooth, uniform structure suitable for being directly secured (e.g., in direct contact) to the base element 2501. In other words, at least a portion of the back surface 2512 may be configured to directly contact the base element 2501 without the placement of an intermediate object therebetween, such as a laminated backing layer or a coating. Currently, an intermediate object or layer is typically applied to a back surface of single-layer woven element incorporating a graphic image prior to bonding to a base element. This intermediate layer primarily is intended to cover loose and exposed floating threads resulting on the back side of the graphic image. This application of an intermediate object or layer, however, compromises certain characteristics of the woven element. For example, the application of an intermediate layer may increase the size, bulkiness, and weight of the woven element and may decrease its flexibility, elasticity, breathability, and susceptibility to wash puckering.

In the currently described embodiments, on the other hand, the multi-layer construction of the woven element 2502 allows for the capturing of any floating portions between the layers (layers 2418 and 2420 of FIG. 24B) and/or incorporates these floating portions as tie structures such that the floating portions do not interrupt the uniformity of the back surface. In effect, the back surface of the woven element is not directly dependent on the position of the image-forming weft threads as called for by the graphic image. As a result of this multi-layered structure, the size, number, and pattern of the weft threads on the front surface may be selected without substantial concern over the impact on the back surface and an intermediate object or layer can be avoided.

A multi-layered woven element in accordance with the described embodiments was tested under the American Society for Testing and Materials ("ASTM") Standard Test Method for Air Permeability of Textile Fabrics (ASTM D737-04(2012)), and shown to have 22% more breathability as compared to a typical single layer woven element incorporating a graphic image and having an attached backing layer suitable for bonding. The same multi-layered woven element had 57.1% less weight than the comparable single layer woven element with the backing layer. As a non-limiting example, a multi-layered woven element in accordance with the described embodiments may have an air permeability as measured according to ASTM D737-04 (2012) in a range of 1-15 cfm, or in a range of 2-11 cfm, or in a range of 9.5-10.5 cfm. As another non-limiting example, a multi-layered woven element in accordance with the described embodiments may have a weight less than 2 grams per meter squared (gsm), or less than 4 gsm, or in a range of 1-2 gsm.

Further, the present embodiments may be advantageous for reducing the degree of wash puckering generally experienced with woven elements having an intermediate layer attached thereto. Wash puckering is generally the result of the threads forming the woven element shrinking at a different rate than the material of an attached textile in response to heat and moisture applied during the washing process. The intermediate layer may restrict the ability of the threads of the woven element to self-adjust in response, therefore causing the woven element to buckle. One feature of the present embodiments is that the threads forming a back surface of the woven element are directly attached to the base textile layer, thereby allowing the threads the freedom to self-adjust in response to the above-described shrinkage differential to eliminate or substantially reduce wash puckering. Further, the multiple layers of the present embodiments may form a more stable woven structure as compared to a woven element with a single layer. The more stable woven structure may reduce the wash puckering internal to the woven element (e.g., the wash puckering resulting from differential shrinkage between the threads forming the woven element).

Figure 26A:
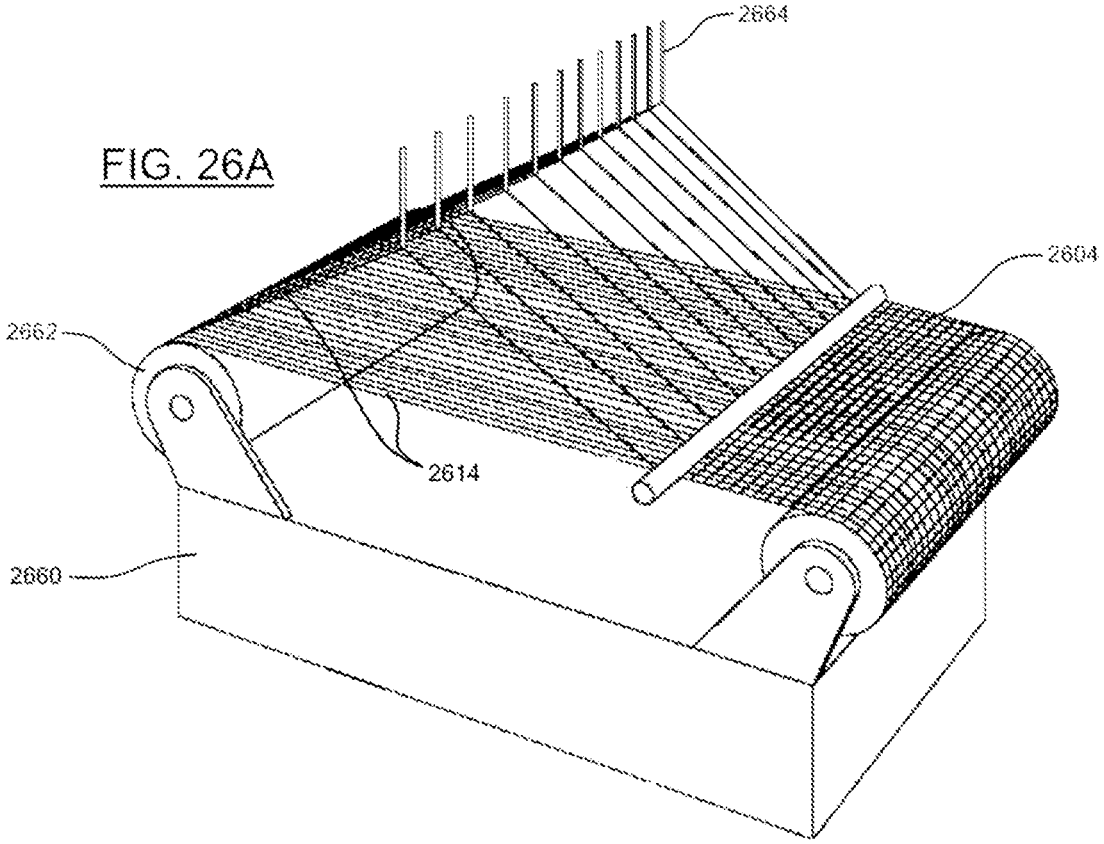
FIG. 26A depicts one embodiment of a loom used to manufacture a multi-layered woven element.

The woven element may be formed from any one of a variety of manufacturing processes, and any of the devices, processes, or features described above may be incorporated. In the embodiment depicted by FIG. 26A, the woven element may be initially woven within a strip 2604 by a loom 2660. The loom 2660 may be any type of device that can control individual warp threads, for example through the use of a Jacquard device, a Dobby loom, or another suitable textile-manufacturing device (e.g., a 288. Satin Broadloom).

As depicted, the warp threads 2614 may be fed from a single warp beam 2662. Each warp thread 2614 may be controlled individually by the Jacquard needles 2664. The warp threads 2614 may selectively be manipulated by the Jacquard needles 2664 to be positioned either up or down when a weft thread is inserted into the shed. The weft thread may be inserted into the shed by any suitable insertion device (not shown), including a shuttle, a rapier, or the like.

The manipulation by the Jacquard needles 2664 during the weaving process may form the tubular structure with multiple layers, as described herein. The warp threads 2614 fed from the warp beam 2662 may be individually controlled to either be associated with the first layer 2418 or dropped to form the second layer 2420 (shown in FIG. 24). To illustrate, when a weft thread primarily associated with the first (top) layer is inserted, all of the warp threads associated with the second (bottom) layer may be held down (unless forming a tie-down structure). The warp threads associated with the top layer may selectively be held up or down depending on the desired path of the inserted weft thread. On the other hand, when a weft thread primarily associated with the second (bottom) layer is to be inserted, all of the warp threads associated with the first (top) layer may be held up (unless forming a tie-down structure), while the warp threads associated with the second (bottom) layer may selectively be held up or down.

Figure 26B:
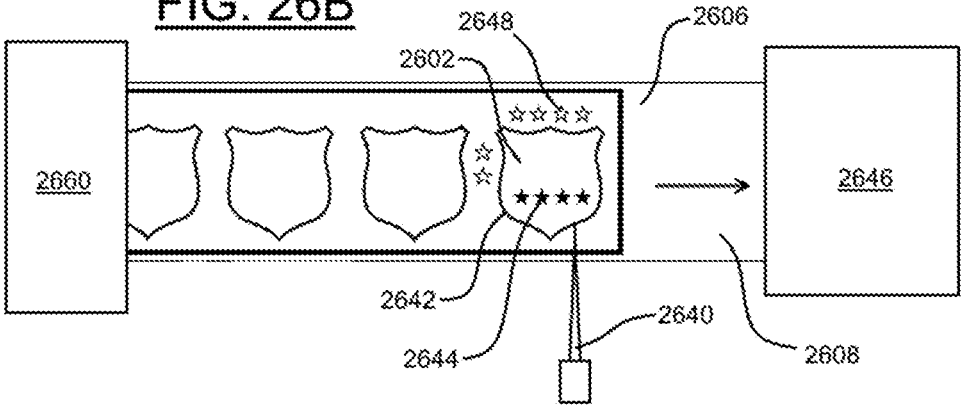
FIG. 26B depicts a diagram of a manufacturing process for manufacturing a multi-layered woven product.

Referring to FIG. 26B, the strip 2604 may be woven by the loom 2660 to include multiple portions defining multiple woven elements 2602. Each woven element 2602 may incorporate the same or a different graphic image, which may include a logo, a colorful design, a single or multi-color region with a cutout or formed from a cutout, etc. After weaving at least a portion of the strip 2604, the strip 2604 may be rolled onto or otherwise attached to a carrier device 2606. The carrier device 2606 may be formed of a belt of paper material, rubber material, plastic material, or any other suitable material. The surface 2608 of the carrier device 2606 may be sticky or tacky to adhere to the strip 2604. The carrier device 2606 may attach to either the front or back surface of the strip 2604.

The carrier device 2606 may transport the strip 2604 to a cutting device, such as a laser cutter 2640. Any other suitable cutting device may be used. The laser cutter 2640 may cut the woven element 2602 to shape. As shown in FIG. 26B, the laser cutter 2640 may cut at an outside border 2642 of the woven element 2602 and/or at an interior area 2644. The interior area 2644 may, for example, define lettering, a logo, an ornamental shape, or the like. Additional shapes 2648 may be cut out of the strip 2604 at locations outside of the boundaries of the woven elements 2602. These shapes 2648 may later be attached to a base element (e.g., a carrier substrate) near the woven element 2602 or may be used for another purpose. The strip 2604 may be woven such that the areas where the shapes 2648 are cut from have a particular color, which may or may not be a color incorporated into the woven element 2602. It is further noted that, while the woven element 2602 is depicted as visible on the strip 2604 in FIG. 26B, this may or may not be the case prior to cutting at the border 2642. In some cases, only one layer may be cut at the interior area 2644 (e.g., when a pocket is formed within the interior area 2644), thereby reducing the woven element to only one layer at that area.

The threads at the border of each cut may fuse together due to the heat provided by the laser, which may substantially prevent the woven element 2602 from unraveling or reduce a propensity of the woven element to unravel at the border. In exemplary embodiments, the carrier device 2606 is not severed by the laser cutter 2640 during the cutting step. Accordingly, after the cutting process, the waste material of the strip 2604 may be peeled away from the carrier device 2606 leaving only the woven element 2602 (and potentially also the shapes 2648). Alternatively, the woven element 2602 may be peeled away first, leaving the woven element 2602 isolated from the waste material of the strip 2604.

After the cutting step, the woven element 2602 may go through one or more post-processing steps 2646. The post-processing steps 2646 may include heat setting, chemical treating, coloring, washing, or the like. The post-processing steps 2646 may additionally or alternatively include cutting, splicing, or otherwise modifying the shape of the woven element 2602, which may involve cutting away or otherwise modifying only one layer (e.g., when a pocket 2352 is formed as shown in FIG. 23). Additional components (e.g., filler or ornamental attachments) may be attached to the woven element 2602 during post-processing. In some embodiments, there are no post-processing steps, or the post-processing steps may be performed prior to cutting or after attachment to base element 2601.

In the embodiment of FIG. 26B, after the post-processing steps 2646, the woven element 2602 may then be applied to the base element as described above with reference to FIG. 25. As described above, the woven element 2602 may include thermoreactive threads exposed on its back surface, and heat may be applied to bond the woven element 2602 to the base element when the woven element 2602 and the base element are in direct contact. This bonding step may occur when the woven element 2602 is still attached to the carrier device 2606 or after removal from the carrier device 2606. In other embodiments, an adhesive may be used as described in detail above. When using an adhesive, the adhesive may be printed or otherwise applied to the woven element 2602 at any point after at least a portion of the woven element 2602 is formed, including prior to the cutting step.

The present embodiments have been described in relation to particular examples, which are intended in all respects to be illustrative rather than restrictive. Alternative embodiments will become apparent to those of ordinary skill in the art to which the present embodiments pertain. Certain features and subcombinations are of utility and may be employed without reference to other features and subcombinations and are contemplated within the scope of the claims.

We claim:

1. A woven element, the woven element comprising:

a first plurality of warp threads extending in a first direction, the first plurality of warp threads being integrated into a first surface of a first layer on a front side of the woven element;

a second plurality of warp threads extending in the first direction, the second plurality of warp threads being integrated into a second surface of a second layer on a back side of the woven element;

a first plurality of weft threads extending in a second direction, the first plurality of weft threads including a first set of weft threads having a first denier and a second set of weft threads having a second denier, the first denier less than the second denier, wherein a first portion of the first set of weft threads is positioned in front of at least two consecutive warp threads of the first plurality of warp threads to form at least a portion of a graphic area on the first surface of the first layer on the front side of the woven element, and wherein a first portion of the second set of weft threads is positioned in front of at least two consecutive warp threads of the first plurality of warp threads to form a non-graphic area on the first surface of the first layer on the front side of the woven element; and a second plurality of weft threads, the second plurality of weft threads having a third denier greater than at least the first denier of the first set of weft threads, wherein the second plurality of weft threads comprises one of a thermopolymer or a thermoplastic polymer material with a melting point lower than a melting point of the first plurality of warp threads, the second plurality of warp threads, and the first plurality of weft threads, wherein a first portion of the second plurality of weft threads is positioned behind at least two consecutive warp threads of the second plurality of warp threads to form at least a portion of the second surface of the second layer on the back side of the woven element.

2. The woven element of claim 1, wherein the second plurality of weft threads is exposed on the second surface of the second layer on the back side of the woven element.

3. The woven element of claim 1, wherein a second portion of each of the first set of weft threads and the second set of weft threads is positioned between the first plurality of warp threads and the second plurality of warp threads for a length extending across three consecutive warp threads of the first plurality of warp threads.

4. The woven element of claim 1, wherein at least the first set of weft threads comprises a third portion, the third portion being positioned behind at least one warp thread of the second plurality of warp threads to form a tie structure.

5. The woven element of claim 1, wherein at least 50% of a length of the second plurality of weft threads is positioned behind the second plurality of warp threads.

6. The woven element of claim 1, further comprising a pocket positioned between the first plurality of warp threads and the second plurality of warp threads.

7. A woven textile element, the woven textile element comprising:

a first layer formed at least in part from a first plurality of warp threads and having a front surface;

a second layer interwoven with the first layer, the second layer formed at least in part from a second plurality of warp threads and having a back surface facing opposite the front surface;

a first plurality of weft threads having a first denier, the first plurality of weft threads integrated into at least the first layer, wherein the first plurality of weft threads comprises an exposed portion, an unexposed portion, and a tie-down portion, wherein the exposed portion is exposed on the front surface, wherein the unexposed portion is positioned between the first layer and the second layer, and wherein the tie-down portion is interwoven with at least one warp thread of the second plurality of warp threads that forms the second layer;

the first plurality of weft threads including a first set of weft threads having a first denier and a second set of weft threads having a second denier, the first denier being less than the second denier, wherein:

a first portion of the first set of weft threads is positioned in front of at least two consecutive warp threads of the first plurality of warp threads to form at least a portion of a graphic area on the first surface of the first layer on the front side of the woven element, and a first portion of the second set of weft threads is positioned in front of at least two consecutive warp threads of the first plurality of warp threads to form a non-graphic area on the first surface of the first layer on the front side of the woven element; and a second plurality of thermoreactive weft threads having a second denier that is greater than the first denier of the first plurality of weft threads, the second plurality of thermoreactive weft threads integrated into at least the second layer, wherein the second plurality of thermoreactive weft threads comprises an exposed portion and an unexposed portion, wherein the exposed portion is exposed on the back surface and comprises greater than 50% of a length of the second plurality of thermoreactive weft threads, wherein the unexposed portion of the second plurality of thermoreactive weft threads is positioned between the first layer and the second layer, and wherein the first layer of the woven textile element comprises approximately 288 warp threads/inch and approximately 5000 weft threads/inch.

8. The woven textile element of claim 7, wherein the exposed portion of the first plurality of weft threads at least partially forms a graphic image on the front surface of the first layer of the woven textile element.

9. The woven textile element of claim 7, further comprising at least one pocket located between the first layer and the second layer.

10. The woven textile element of claim 9, wherein the at least one pocket comprises at least one aperture.

11. The woven textile element of claim 7, wherein the unexposed portion of the first plurality of weft threads is positioned between the first layer and the second layer continuously for a length extending across three consecutive warp threads of the first plurality of warp threads of the first layer.

12. The woven textile element of claim 7, wherein the second plurality of thermoreactive weft threads has a melting point lower than a melting point of the first plurality of weft threads, the first plurality of warp threads, and the second plurality of warp threads.

13. An article, the article comprising:

a woven element having a first surface on a front side of a first layer of the woven element and a second surface on a back side of a second layer of the woven element, the first layer of the woven element comprising:

a high resolution area comprising a first set of warp threads extending in a first direction, the first set of warp threads being integrated into the first surface on the front side of the first layer of the woven element, the first set of warp threads having a denier of about 50 D and a first density;

a non-high resolution area comprising a second set of warp threads extending in the first direction, the second set of warp threads being integrated into the first surface on the front side of the first layer of the woven element, the first set of warp threads being a greater number than the second set of warp threads, the second set of warp threads having a denier of about 75D and a second density, which is less than the first density;

a first plurality of weft threads extending in a second direction, wherein a first portion of the first plurality of weft threads is positioned in front of at least one warp thread of the first set of warp threads to form at least a portion of the high resolution area on the first surface on the front side of the first layer of the woven element, the second layer of the woven element comprising:

a second plurality of warp threads extending in the first direction, the second plurality of warp threads being integrated into the second surface on the back side of the second layer of the woven element, a second plurality of weft threads extending in the second direction, the second plurality of weft threads comprising one of a thermopolymer or a thermoplastic polymer material, wherein greater than 50% of a length of the second plurality of weft threads is exposed on the second surface on the back side of the second layer of the woven element; and a base textile element, the base textile element being secured to and in direct contact with the second surface on the back side of the second layer of the woven element.

14. The article of claim 13, wherein the second surface of the woven element is secured to the base textile element with an adhesive.

15. The article of claim 13, wherein the second plurality of weft threads is adapted to melt upon the application of an amount of heat to secure the second surface of the woven element to the base textile element.

16. The woven element of claim 1, wherein the first surface of the first layer on the front side of the woven element includes one or more picks that each include multiple weft threads of the first set of weft threads.

17. The article of claim 13, wherein in the high resolution area, there are a greater number of warp yarns in the first layer compared to the second layer of the woven element.

18. The article of claim 13, wherein in the non-high resolution area, there are a greater number of warp yarns in the second layer compared to the first layer of the woven element.

* * * * *